US005858610A

United States Patent [19]

Ezoe et al.

[11] Patent Number: 5,858,610

[45] Date of Patent: Jan. 12, 1999

[54] METHOD OF DEVELOPING A HYDRAZINE-CONTAINING LIGHT-SENSITIVE MATERIAL TO FORM AN IMAGE

[75] Inventors: Toshihide Ezoe; Kohzaburoh Yamada, both of Kanagawa, Japan

[73] Assignee: Fuji Photo Film Co., Ltd., Kanagawa, Japan

[21] Appl. No.: 838,293

[22] Filed: Apr. 17, 1997

[30] Foreign Application Priority Data

Apr. 17, 1996 [JP] Japan ..... 8-095474
Apr. 18, 1996 [JP] Japan ..... 8-096884

[51] Int. Cl.[6] ..... G03C 1/00
[52] U.S. Cl. ..... 430/264; 430/399
[58] Field of Search ..... 430/264, 399

[56] References Cited

U.S. PATENT DOCUMENTS

| | | | |
|---|---|---|---|
| 4,929,535 | 5/1990 | Takahashi et al. | 430/264 |
| 5,187,058 | 2/1993 | Inoue | 430/583 |
| 5,212,045 | 5/1993 | Koga et al. | 430/264 |
| 5,236,816 | 8/1993 | Purol et al. | 430/492 |
| 5,340,695 | 8/1994 | Yamaguchi | 430/264 |
| 5,382,507 | 1/1995 | Shimizu et al. | 430/399 |

FOREIGN PATENT DOCUMENTS

| | | |
|---|---|---|
| 416938 | 1/1992 | Japan . |
| 5127287 | 5/1993 | Japan . |
| 5142688 | 6/1993 | Japan . |
| 5197091 | 8/1993 | Japan . |
| A-5-197091 | 8/1993 | Japan . |
| 6148777 | 5/1994 | Japan . |
| 9532453 | 11/1995 | WIPO . |

*Primary Examiner*—Janet Baxter
*Assistant Examiner*—John VanderWilt
*Attorney, Agent, or Firm*—Sughrue, Mion, Zinn, Macpeak & Seas, PLLC

[57] ABSTRACT

An image forming method comprising developing a silver halide photographic light-sensitive material which comprises a support having thereon at least one light-sensitive silver halide emulsion layer: wherein the silver halide photographic light-sensitive material contains at least one kind of hydrazine derivative represented by general formula (NB) in at least one layer of the silver halide emulsion layer(s) and other hydrophilic colloidal layers:

$$A—(B)_m \qquad \text{(NB)}$$

and wherein the development is conducted by using a developing solution having a pH of from not less than 8.5 to less than 11.0, which developing solution does not substantially contain a dihydroxybenzene developing agent, but contains a developing agent represented by general formula (1):

(1)

The symbols used in the above formulas are defined in the specification.

6 Claims, No Drawings

METHOD OF DEVELOPING A HYDRAZINE-CONTAINING LIGHT-SENSITIVE MATERIAL TO FORM AN IMAGE

FIELD OF THE INVENTION

The present invention relates to an image forming method using a silver halide photographic light-sensitive material. More particularly, the invention relates to an image forming method using an ultrahigh-contrast silver halide photographic light-sensitive material for a photomechanical process.

BACKGROUND OF THE INVENTION

In recent years, photographic materials having good original reproducibility and processing systems which can reduce processing waste liquid have been desired in order to cope with the diversity and complexity of printed matter and from increasing awareness of the environment in the field of photomechanical processes.

In order to improve the reproduction of continuous-gradational halftone dot images or line images, image formation systems exhibiting ultrahigh-contrast (particularly, γ is 10 or more) photographic characteristics are needed.

As methods for obtaining high-contrast photographic characteristics, lithographic development systems utilizing the so-called "infectious development effect" have been used for long. However, they have the problem that the developing solutions are unstable and hard to be used. On the other hand, U.S. Pat. Nos. 4,166,742, 4,168,977, 4,221,857, 4,224,401, 4,243,739, 4,269,922, 4,272,606, 4,311,781, 4,332,878, 4,618,574, 4,634,661, 4,618,836 and 5,650,746 disclose systems for processing hydrazine derivative-containing silver halide photographic materials of the surface latent image type with a stable MQ or PQ developing solution having a pH of 11.0 to 12.3 to obtain ultrahigh-contrast negative images having a γ value exceeding 10.

According these methods, ultrahigh-contrast and high-sensitive photographic characteristics can be obtained, and sulfites can be added in high concentration to the developing solutions. Therefore, the stability against air oxidation of the developing solutions is markedly improved, compared with the conventional lithographic developing solutions.

In the above-mentioned methods, the sulfite preservatives of high concentration make it possible to enhance the stability of the developing solutions. In order to obtain ultrahigh-contrast photographic images, however, it is necessary to use developing solutions having a relatively high pH value. Accordingly, the developing solutions are easily air oxidized, which requires that the developing solutions are replenished in large amounts. Then, attempts to realize systems for forming ultrahigh-contrast photographic images utilizing hydrazine derivatives with a developing solution of lower pH have been made.

U.S. Pat. No. 4,269,929 (corresponding to JP-A-61-267759 (the term "JP-A" as used herein means an "unexamined published Japanese patent application")), U.S. Pat. No. 4,737,452 (corresponding to JP-A-60-179734), U.S. Pat. Nos. 5,104,769 and 4,798,780, JP-A-1-179939, JP-A-1-179940, U.S. Pat. Nos. 4,998,604 and 4,994,365 and JP-A-8-272023 disclose methods of using high-active hydrazine nucleating agents and nucleating accelerators for obtaining ultrahigh-contrast images by using a stable developing solution having a pH of less than 11.0. It is also disclosed that silver halide emulsions which has a high silver chloride content and which is chemically sensitized have high nucleating activity.

Further, hydrazine nucleating agents each having at least two hydrazine groups in a molecule are disclosed in JP-A-4-16938, JP-A-5-197091, JP-A-5-127287, JP-A-5-142688 and JP-A-6-148777.

In the methods known in the art, however, when one meter square of the silver halide photographic material is processed, the replenishing rate of the developing solution is required to be about from 150 ml to 450 ml. In these days when concern about environmental problems has been increased, a demand for waste liquid reduction is further increased, and an improvement in processing stability, particularly in the dependency of photographic sensitivity on the pH of the developing solution which comes into question in the hydrazine nucleating system has been strongly desired.

Further, there is also a problem such that when the high-active hydrazine nucleating agent as described above is used, sand-like fog called black peppers are readily caused in undeveloped areas.

On the other hand, a need for photographic materials for scanner output has bee growing year by year, and it has been desired to satisfy both requirements for good definition (on/off) of edge portions of images and for reduced processing unevenness (density unevenness remarkably observed in case where the output is performed for wide area at uniform dot percent). That is, there has been the dilemma that the definition of edge portions of images can be improved by enlargement of the images by nucleating infectious development, but such a photographic material with enlarged images tends to cause the processing unevenness.

With respect to photographic materials for daylight dot to dot work, there is a problem that nucleating development is quite hard to take place because of a reduction in sensitivity of the emulsion used in the system. Accordingly, the development of a technique to make the contrast higher even using a low-pH developing solution has been desired.

Hydrazine nucleating agents each having two or more hydrazide groups in a molecule are disclosed in JP-A-4-16938, JP-A-5-197091, JP-A-5-127287, JP-A-5-142688 and JP-A-6-148777. However, the above described problems are not solved yet.

SUMMARY OF THE INVENTION

It is therefore an object of the present invention to provide an image forming method using a silver halide photographic light-sensitive material which is ultrahigh-contrast, excellent in processing stability and develops no black peppers.

Another object of the present invention is to provide a photographic material for scanner output which provides images having a good definition in edge portions and which is less liable to processing unevenness.

Other objects and effects of the present invention will be apparent from the following description.

The above objects of the present invention have been achieved by providing an image forming method comprising developing a silver halide photographic light-sensitive material which comprises a support having thereon at least one light-sensitive silver halide emulsion layer, wherein the silver halide photographic light-sensitive material contains at least one kind of hydrazine derivative represented by general formula (NB) in at least one layer of the silver halide emulsion layer(s) and other hydrophilic colloidal layers:

$$A—(B)_m \qquad (NB)$$

wherein A represents a connecting group, B represents a group represented by the following general formula (B-1), and m represents an integer of 2 to 6:

$$-(L_2-Ar_2)_n-L_1-Ar_1-NHNH-G_1-R_1 \quad \text{(B-1)}$$

wherein $Ar_1$ and $Ar_2$ each represents an aromatic group or an aromatic heterocyclic group; $L_1$ and $L_2$ each represents a connecting group; n represents 0 or 1; $R_1$ represents a hydrogen atom, an alkyl group, an aryl group, a heterocyclic group, an alkoxyl group, an aryloxy group, an amino group or a hydrazino group; $G_1$ represents —CO—, —$SO_2$—, —SO—, —P(=O)($R_2$)—, —CO—CO—, a thiocarbonyl group or an iminomethylene group; $R_2$ is selected from those defined for $R_1$ and may be different from $R_1$, and wherein the development is conducted by using a developing solution having a pH of from not less than 8.5 to less than 11.0, which developing solution does not substantially contain a dihydroxybenzene developing agent, but contains a developing agent represented by general formula (1):

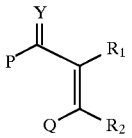

(1)

wherein $R_1$ and $R_2$ each represents a hydroxyl group, an amino group, an acylamino group, an alkylsulfonylamino group, an arylsulfonylamino group, an alkoxycarbonylamino group, a mercapto group or an alkylthio group; P and Q each represents a hydroxyl group, a hydroxyalkyl group, a carboxyl group, a carboxyalkyl group, a sulfo group, a sulfoalkyl group, an amino group, an aminoalkyl group, an alkyl group, an alkoxyl group, a mercapto group, or P and Q represent atomic groups necessary for bonding each other to form a 5-, 6- or 7-membered ring together with the two vinyl carbon atoms at which $R_1$ and $R_2$ are substituted and with the carbon atom at which Y is substituted; =Y represents =O or =N—$R_3$; and $R_3$ represents a hydrogen atom, a hydroxyl group, an alkyl group, an acyl group, a hydroxyalkyl group, a sulfoalkyl group or a carboxyalkyl group.

In a preferred embodiment, the silver halide photographic light-sensitive material further contains a nucleating accelerator in at least one layer of the silver halide emulsion layer(s) and other hydrophilic colloidal layers.

In a further preferred embodiment, the nucleating accelerator comprises at least one kind of nucleating accelerator represented by general formula (A-1), (A-2), (A-3) or (A-4):

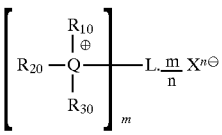

(A-1)

wherein $R_{10}$, $R_{20}$ and $R_{30}$ each represents an alkyl group, a cycloalkyl group, an aralkyl group, an aryl group, an alkenyl group, a cycloalkenyl group, an alkynyl group or a heterocyclic group; Q represents a nitrogen atom or a phosphorus atom; L represents an m-valent organic group bonded to $Q^+$ with its carbon atom, wherein m represents an integer of from 1 to 4; and $X^{n-}$ represents an n-valent counter anion, wherein n represents an integer of from 1 to 3, providing that when $R_{10}$, $R_{20}$, $R_{30}$ or L has an anion group in its substituent group to form an internal salt with $Q^+$, $X^{n-}$ is not needed;

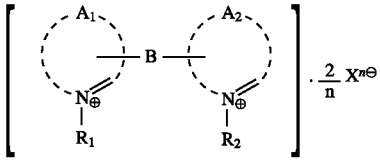

(A-2)

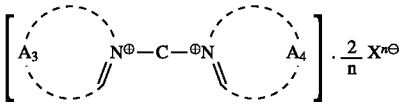

(A-3)

wherein $A_1$, $A_2$, $A_3$ and $A_4$ each represents an organic residue which contains a quaternized nitrogen atom and is for completing a substituted or unsubstituted unsaturated heterocyclic ring; B and C each represents a divalent connecting group comprising alkylene, arylene, alkenylene, alkynylene, —$SO_2$—, —SO—, —O—, —S—, —N($R_N$)—, —C=O— or —P=O—, alone or in combination of two or more thereof, wherein $R_N$ represents a hydrogen atom, an alkyl group, an aryl group or an aralkyl group; $R_1$ and $R_2$ each represents an alkyl group or an aralkyl group; and $X^{n-}$ represents an n-valent counter anion, wherein n represents an integer of from 1 to 3, providing that when an internal salt can be formed, $X^{n-}$ is not needed; and

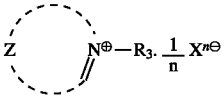

(A-4)

wherein Z represents an organic residue which contains a quaternized nitrogen atom and is for completing a substituted or unsubstituted unsaturated heterocyclic ring; $R_3$ represents an alkyl group or an aralkyl group; and $X^{n-}$ represents an n-valent counter anion, wherein n represents an integer of from 1 to 3, providing that when an internal salt can be formed, $X^{n-}$ is not needed.

DETAILED DESCRIPTION OF THE INVENTION

The present invention will be described in detail below.

The hydrazine derivative (nucleating agent) for use in the present invention is described below.

The hydrazine derivative for use in the present invention is represented by general formula (NB):

$$A-(B)_m \quad \text{(NB)}$$

wherein A represents a connecting group, B represents a group represented by the following general formula (B-1), and m represents an integer of 2 to 6:

$$-(L_2-Ar_2)_n-L_1-Ar_1-NHNH-G_1-R_1 \quad \text{(B-1)}$$

wherein $Ar_1$ and $Ar_2$ each represents an aromatic group or an aromatic heterocyclic group; $L_1$ and $L_2$ each represents a connecting group; n represents 0 or 1; $R_1$ represents a hydrogen atom, an alkyl group, an aryl group, a heterocyclic group, an alkoxyl group, an aryloxy group, an amino group or a hydrazino group; $G_1$ represents —CO—, —$SO_2$—, —SO—, —P(=O)($R_2$)—, —CO—CO—, a thiocarbonyl group or an iminomethylene group; $R_2$ is selected from the same groups as defined for $R_1$ and may be different from $R_1$.

In general formula (B-1), the aromatic group represented by $Ar_1$ and $Ar_2$ is a monocyclic or bicyclic aryl group such as a benzene ring or a naphthalene ring. The aromatic heterocyclic group represented by $Ar_1$ and $Ar_2$ is a monocyclic or bicyclic aromatic heterocyclic group, and may be condensed with other aryl groups. Examples thereof include pyridine, pyrimidine, imidazole, pyrazole, quinoline, isoquinoline, benzimidazole, thiazole and benzothiazole rings.

$Ar_1$ and $Ar_2$ are preferably aromatic groups, and more preferably phenylene groups.

$Ar_1$ and $Ar_2$ may be substituted, and typical examples of the substituent group include alkyl (including active methine), alkenyl, alkynyl, aryl, heterocyclic groups, quaternized nitrogen atom-containing heterocyclic groups (for example, pyridinio), hydroxyl, alkoxyl (including groups repeatedly containing ethyleneoxy group or propyleneoxy group units), aryloxy, acyloxy, acyl, alkoxycarbonyl, aryloxycarbonyl, carbamoyl, urethane, carboxyl (including salts thereof), imido, amino, carbonamido, sulfonamido, ureido, thioureido, sulfamoylamino, semicarbazido, thiosemicarbazido, hydrazino, quaternary ammonio, mercapto, (alkyl, aryl or heterocyclic)thio, (alkyl or aryl) sulfonyl, (alkyl or aryl)sulfinyl, sulfo (including salts thereof), sulfamoyl, acylsulfamoyl, (alkyl or aryl) sulfonylureido, (alkyl or aryl)sulfonylcarbamoyl, halogen atoms, cyano, nitro, phosphoric acid amido, groups having a phosphoric ester structure, acylureido, selenium or tellurium atom-containing groups, groups having a tertiary or quaternary sulfonium structure and quaternized phosphorus atom-containing groups. These substituent groups may be further substituted by these substituent groups.

Preferred examples of the substituent group include alkyl having 1 to 20 carbon atoms, aralkyl, heterocyclic groups, substituted amino, acylamino, sulfonamido, ureido, sulfamoylamino, imido, thioureido, phosphoric acid amido, hydroxyl, alkoxyl, aryloxy, acyloxy, acyl, alkoxycarbonyl, aryloxycarbonyl, carbamoyl, carboxyl (including salts thereof), (alkyl, aryl or heterocyclic)thio, sulfo (including salts thereof), sulfamoyl, halogen atoms, cyano and nitro.

$Ar_1$ is preferably an unsubstituted phenylene group.

In general formula (B-1), the alkyl group represented by $R_1$ is preferably an alkyl group having 1 to 10 carbon atoms, and the aryl group is preferably a monocyclic or bicyclic aryl group, for example, those containing a benzene ring.

The heterocyclic group is a 5- or 6-membered ring compound containing at least one of nitrogen, oxygen and sulfur atoms. Examples thereof include imidazolyl, pyrazolyl, triazolyl, tetrazolyl, pyridyl, pyridinio, quinolinio and quinolinyl groups. Pyridyl and pyridinio groups are particularly preferred.

The alkoxyl group is preferably an alkoxyl group having 1 to 8 carbon atoms, and the aryloxy group is preferably a monocyclic group. The amino group is preferably an unsubstituted amino group, or an alkylamino having 1 to 10 carbon atoms, arylamino or substituted or unsubstituted heterocyclic amino group.

$R_1$ may be substituted, and preferred substituent groups are the same as those shown as the substituent group for $Ar_1$ and $Ar_2$.

Of the groups represented by $R_1$, when $G_1$ is a —CO— group, preferred examples of $R_1$ include a hydrogen atom, alkyl groups (for example, methyl, trifluoromethyl, difluoromethyl, 2-carboxytetrafluoroethyl, pyridiniomethyl, 3-hydroxypropyl, 3-methanesulfonamidopropyl and phenylsulfonylmethyl), aralkyl groups (for example, o-hydroxybenzyl) and aryl groups (for example, phenyl, 3,5-dichlorophenyl, o-methanesulfonamidophenyl, o-carbamoylphenyl, 4-cyanophenyl and 2-hydroxymethylphenyl). In particular, a hydrogen atom and alkyl groups are preferred.

When $G_1$ is an —$SO_2$— group, $R_1$ is preferably an alkyl group (for example, methyl), an aralkyl group (for example, o-hydroxybenzyl), an aryl group (for example, phenyl) or a substituted amino group (for example, dimethylamino).

When $G_1$ is a —COCO— group, $R_1$ is preferably an alkoxyl group, an aryloxy group or an amino group. In particular, alkylamino groups, arylamino groups and heterocyclic amino groups are preferred. Examples thereof include, for example, 2,2,6,6-tetramethylpiperidine-4-ylamino, propylamino, anilino, o-hydroxyanilino, 5-benzotriazolylamino and N-benzyl-3-pyridinioamino).

Further, $R_1$ may be a group which cleaves the $G_1$—$R_1$ moiety from the residual molecule to induce the cyclization reaction for forming a cyclic structure containing atoms of the —$G_1$—$R_1$ moiety, and examples thereof include those described in JP-A-63-29751.

An adsorbent group to be adsorbed by a silver halide may be incorporated into the compound represented by general formula (NB). Examples of such an adsorbent group include those described in U.S. Pat. Nos. 4,385,108 and 4,459,347, JP-A-59-195233, JP-A-59-200231, JP-A-59-201045, JP-A-59-201046, JP-A-59-201047, JP-A-59-201048, JP-A-59-201049, JP-A-61-170733, JP-A-61-270744, JP-A-62-948, JP-A-63-234244, JP-A-63-234245 and JP-A-63-234246, such as alkylthio, arylthio, thiourea, thioamido, mercapto heterocyclic and triazole groups. These adsorbent groups to the silver halides may be precursors thereof. Examples of such a precursor include those described in JP-A-2-285344.

In general formula (B-1), the connecting groups represented by $L_1$ and $L_2$ each represents —O—, —S—, —N($R_N$)— (wherein $R_N$ represents a hydrogen atom, an alkyl group or an aryl group), —CO—, —C(=S)—, —$SO_2$—, —SO—, —P=O— or an alkylene group, which may be alone or a combination thereof. Specific examples of the combined groups include —CON($R_N$)—, —$SO_2$N($R_N$)— —COO—, —N($R_N$)CON($R_N$)—, —N($R_N$)CSN($R_N$)—, —N($R_N$)$SO_2$N($R_N$)—, —$SO_2$N($R_N$)CO—, —$SO_2$N($R_N$)CON($R_N$)—, —N($R_N$)COCON($R_N$)—, —CON($R_N$)CO—, —S—(alkylene group)—CONH—, —O—(alkylene group)—CONH— and —O—(alkylene group)—NHCO—. These groups may be connected from either the right or left side.

When the connecting groups represented by $L_1$ and $L_2$ in general formula (B-1) each contains a trivalent or more valent group, $L_1$ may connect two or more groups represented by —$Ar_1$—NHNH—$G_1$—$R_1$ in general formula (B-1), and $L_2$ may connect two or more groups represented by —$Ar_2$—$L_1$—$Ar_1$—NHNH—$G_1$—$R_1$ in general formula (B-1).

In this case, the trivalent or more valent connecting group contained in each of $L_1$ and $L_2$ is specifically an amino group or an alkylene group.

In general formula (B-1), $L_1$ is preferably —$SO_2$NH—, —NHCONH—, —NHC(=S)NH—, —OH—, —S—, —N($R_N$)— or an active methylene group, and particularly preferably —$SO_2$NH—. $L_2$ is preferably —CON($R_N$)—, —$SO_2$N($R_N$)—, —COO—, —N($R_N$)CON($R_N$)— or —N($R_N$)CSN($R_N$)—.

The connecting group represented by A in general formula (NB) is a divalent to hexavalent connecting group which can connect 2 to 6 groups represented by B, such as —O—, —S—, —N($R_N$')— (wherein $R_N$' represents a hydrogen atom, an alkyl group or an aryl group), —$N^+$($R_N$')$_2$— (wherein each $R_N$' may be the same or different, and may combine with each other to form a ring), —CO—, —C(=S)—, —$SO_2$—, —SO—, —P=O—, an alkylene group, a cycloalkylene group, an alkenylene group, an alkynylene group, an arylene group or a heterocyclic group, which may be alone or in combination of two of more thereof, or a single bond. The heterocyclic group as used herein may be a heterocyclic group containing a quaternized nitrogen atom such as a pyridinio group.

The connecting group represented by A in general formula (NB) may be substituted. Examples of the substituent group include the same substituent groups as ones which $Ar_1$ and $Ar_2$ of general formula (B-1) may have.

When n is 0, the connecting group represented by A preferably contains at least one of benzene rings, naphthalene rings, saturated or unsaturated heterocyclic rings, heterocyclic rings containing a quaternized nitrogen atom such as a pyridinio group, quaternized nitrogen atoms such as an ammonio group and cycloalkylene groups.

When n is 1, the connecting group represented by A preferably contains at least one of a single bond, benzene rings, naphthalene rings, saturated or unsaturated heterocyclic rings, heterocyclic rings containing a quaternized nitrogen atom such as a pyridinio group, quaternized nitrogen atoms such as an ammonio group and cycloalkylene groups.

In general formula (NB), m represents an integer of from 2 to 6. It is however preferably 2, 3 or 4, and more preferably 2 or 3.

Specific examples of the compounds represented by general formula (NB) are shown below, but the present invention is not limited thereto.

| | | R = | | | |
|---|---|---|---|---|---|
| | | $-H$ | $-CF_2H$ | 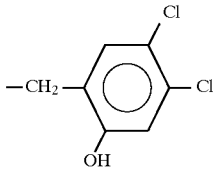 | $-CONHC_3H_7$ |
| 1 | 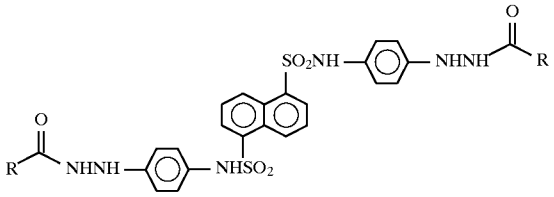 | 1a | 1e | 1k | 1l |
| 2 | 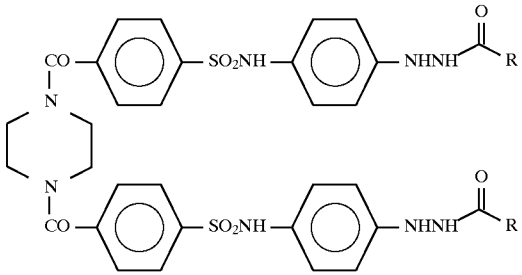 | 2a | 2e | 2k | 2l |
| 3 | 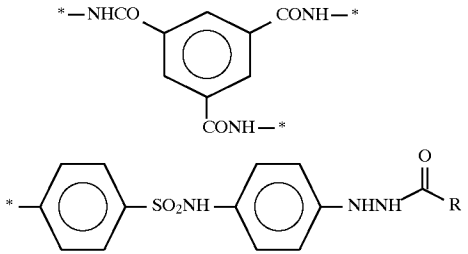 | 3a | 3e | 3k | 3l |

-continued
| | | R = | | | |
|---|---|---|---|---|---|
| | B = —$SO_2NH$— 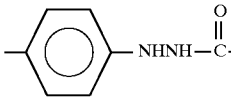 —NHNH—C(=O)—R | —H | —$CF_2H$ | —$CF_3$ | —$CF_2SCH_3$ |
| 4 | 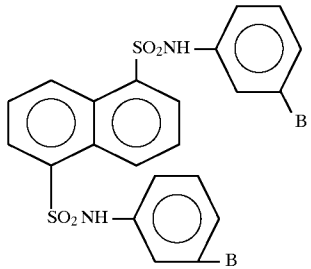 | 4a | 4e | 4c | 4r |
| 5 | 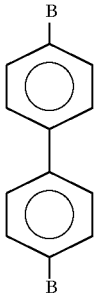 | 5a | 5e | 5c | 5r |
| 6 | 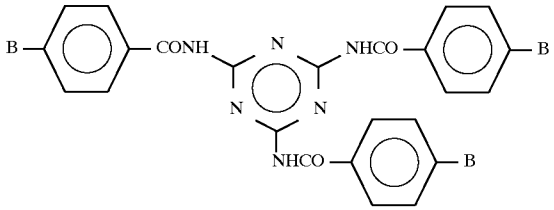 | 6a | 6e | 6c | 6r |

-continued
| | | | | | |
|---|---|---|---|---|---|
| 7 | 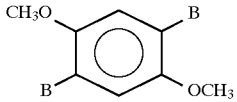 | 7a | 7e | 7c | 7r |
| 8 | 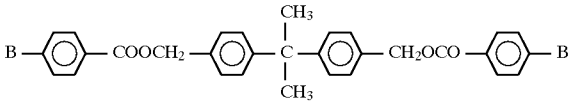 | 8a | 8e | 8c | 8r |
| | | R = | | | |
| | 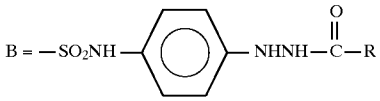 | −H | $-CF_2H$ | $-CONHCH_3$ | $-CF_2OCH_3$ |
| 9 | 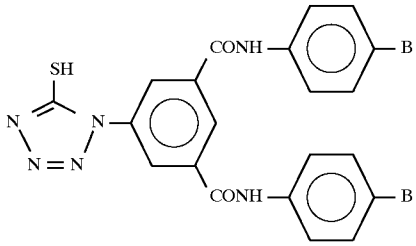 | 9a | 9e | 9p | 9b |
| 10 | 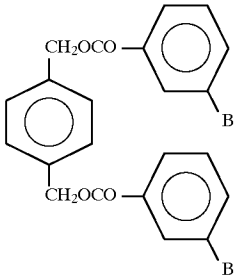 | 10a | 10e | 10p | 10b |

-continued
| | | R = | | | |
|---|---|---|---|---|---|
| | | —H | —$CF_2H$ | 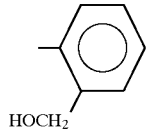 | 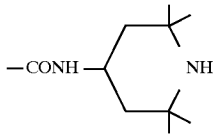 |
| 11 | 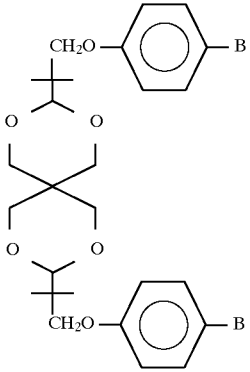 | 11a | 11e | 11f | 11g |
| | | R = | | | |
|---|---|---|---|---|---|
| | B' = 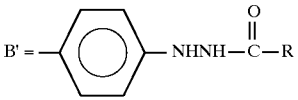 | —H | —$CF_2H$ | 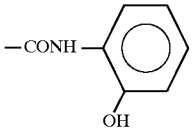 | 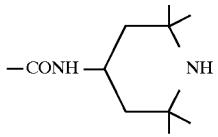 |
| 12 | 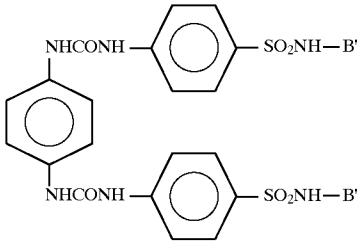 | 12a | 12e | 12s | 12g |

-continued
| | | | | | |
|---|---|---|---|---|---|
| 13 | 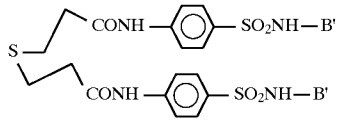 | 13a | 13e | 13s | 13g |
| 14 | 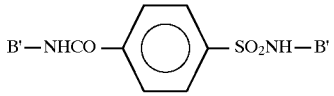 | 14a | 14e | 14s | 14g |
| 15 | 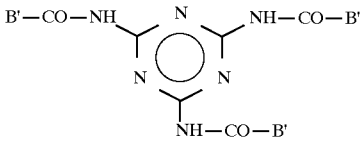 | 15a | 15e | 15s | 15g |
| 16 | 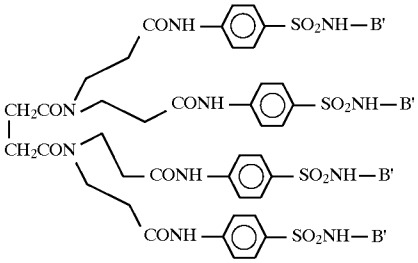 | 16a | 16e | 16s | 16g |
| 17 | 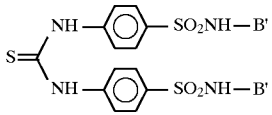 | 17a | 17e | 17s | 17g |
| 18 | 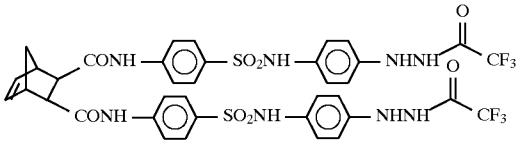 | | | | |
| 19 | 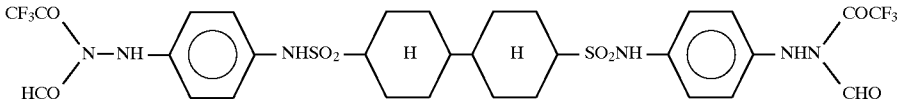 | | | | |

-continued
20
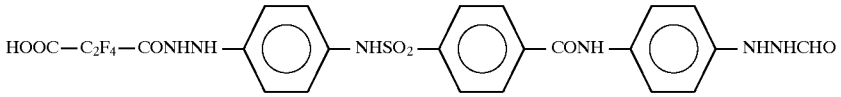
21
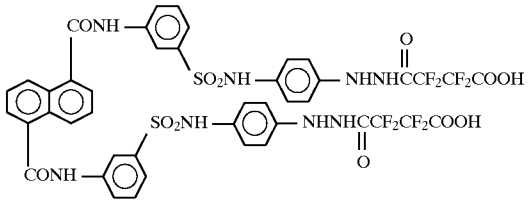
22
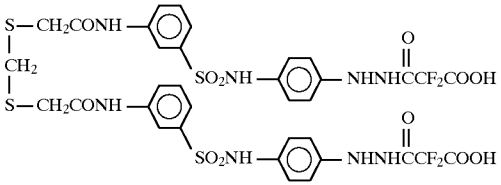
| | | R = | | | | |
|---|---|---|---|---|---|---|
| | 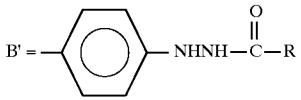 | —H | —$CF_3$ | —$CF_2H$ | 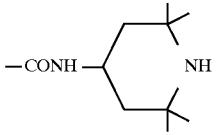 | 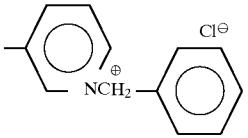 |
| 23 | 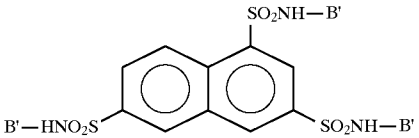 | 23a | 23c | 23e | 23g | 23d |
| 24 | 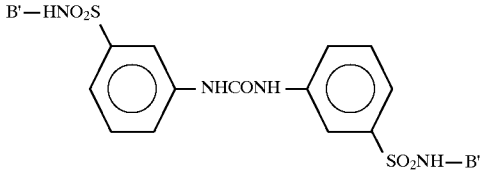 | 24a | 24c | 24e | 24g | 24d |

-continued
| | | | | | | |
|---|---|---|---|---|---|---|
| 25 | 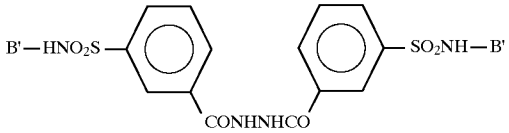 | 25a | 25c | 25e | 25g | 25d |
| 26 | 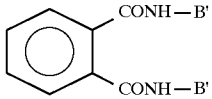 | 26a | 26c | 26e | 26g | 26d |
| | 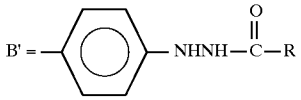 | R = | | | | |
| | | —H | —$CF_3$ | —$CF_2H$ | —$CONHCH_3$ | 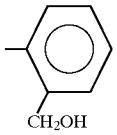 —$C_2F_4COOH$ |
| 27 | 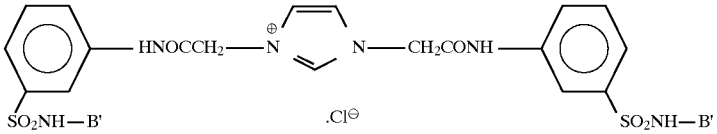 | 27a | 27c | 27e | 27p | 27f | 27t |
| 28 | 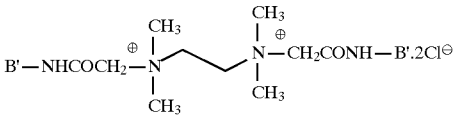 | 28a | 28c | 28e | 28p | 28f | 28t |
| 29 | 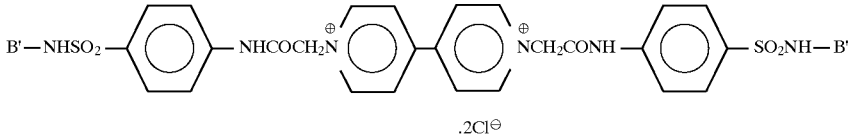 | 29a | 29c | 29e | 29p | 29f | 29t |
| 30 | 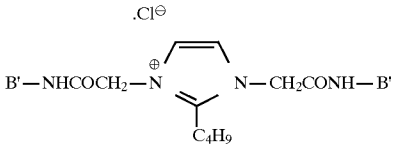 | 30a | 30c | 30e | 30p | 30f | 30t |

In the present invention, the hydrazine derivative can be used by dissolving it in an appropriate water-miscible organic solvent, for example, alcohols (such as methanol, ethanol, propanol and fluorinated alcohol), ketones (such as acetone and methyl ethyl ketone), dimethylformamide, dimethyl sulfoxide and methyl cellosolve.

Further, by emulsifying dispersion methods already well known, the hydrazine derivative can also be dissolved using an oil such as dibutyl phthalate, tricresyl phosphate, glyceryl triacetate and diethyl phthalate, or using an auxiliary solvent such as ethyl acetate and cyclohexanone, to mechanically prepare an emulsified dispersion to be used. Alternatively, the hydrazine derivative can also be used by dispersing the powder thereof in water using a ball mill, a colloid mill or ultrasonic waves.

In the present invention, the hydrazine derivative may be added to any of silver halide emulsion layer(s) and other hydrophilic colloidal layer(s) on the silver halide emulsion layer side of a support. However, the hydrazine derivative is preferably added to the silver halide emulsion layer(s) or hydrophilic colloidal layers adjacent thereto.

In the present invention, the addition amount of the hydrazine derivative is preferably $1\times10^{-6}$ to $1\times10^{-2}$ mol, more preferably $1\times10^{-5}$ to $5\times10^{-3}$ mol, and most preferably $2\times10^{-5}$ to $5\times10^{-3}$ mol, per mol of silver halide.

In the present invention, a nucleating accelerator is preferably added to at least one of silver halide emulsion layer(s) and other hydrophilic colloidal layer(s) of the silver halide photographic material.

The nucleating accelerator for use in the present invention include amine derivatives, onium salts, disulfide derivatives and hydroxymethyl derivatives. Examples thereof are enumerated below.

Compounds described in JP-A-7-77783, page 48, lines 2 to 37, specifically, compounds A-1) to A-73) described on pages 49 to 58 thereof; and compounds represented by general formulas [Na] and [Nb] described in JP-A-7-104426, specifically, compounds Na-1 to Na-22 and Nb-1 to Nb-12 described on pages 16 to 20 thereof.

In the present invention, onium salt compounds represented by general formulas (A-1), (A-2), (A-3) and (A-4) are most preferably used as the nucleating accelerator.

The onium salts are described in detail below.

First, general formula (A-1) is described in detail.

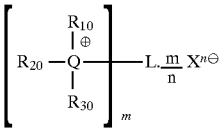

(A-1)

wherein $R_{10}$, $R_{20}$ and $R_{30}$ each represents an alkyl group, a cycloalkyl group, an aralkyl group, an aryl group, an alkenyl group, a cycloalkenyl group, an alkynyl group or a heterocyclic group, which may further have a substituent group.

L represents an m-valent organic group bonded to $Q^+$ with its carbon atom, wherein m represents an integer of from 1 to 4. $X^{n-}$ represents an n-valent counter anion, wherein n represents an integer of from 1 to 3. However, when $R_{10}$, $R_{20}$, $R_{30}$ or L has an anion group in its substituent group to form an internal salt with $Q^+$, $X^{n-}$ is not needed.

Examples of the groups represented by $R_{10}$, $R_{20}$ and $R_{30}$ include straight or branched chain alkyl groups such as methyl, ethyl, propyl, isopropyl, butyl, isobutyl, sec-butyl, tert-butyl, octyl, 2-ethylhexyl, dodecyl, hexadecyl and octadecyl; aralkyl groups such as substituted or unsubstituted benzyl; cycloalkyl groups such as cyclopropyl, cyclopentyl and cyclohexyl; aryl groups such as phenyl, naphthyl and phenanthryl; alkenyl groups such as allyl, vinyl and 5-hexenyl; cycloalkenyl groups such as cyclopentenyl and cyclohexenyl; alkynyl groups such as phenylethyl; and heterocyclic groups such as pyridyl, quinolyl, furyl, imidazolyl, thiazolyl, thiadiazolyl, benzotriazolyl, benzothiazolyl, morpholyl, pyrimidyl and pyrrolidyl.

Examples of the substituent group substituted on these groups include halogen atoms such as fluorine, chlorine, bromine and iodine atoms, nitro, (alkyl or aryl)amino, alkoxyl, aryloxy, (alkyl or aryl)thio, carbonamido, carbamoyl, sulfonamido, sulfamoyl, hydroxyl, sulfoxy, sulfonyl, carboxyl (including carboxylates), sulfonic acid (including sulfonates), cyano, oxycarbonyl and acyl groups, as well as the groups represented by $R_{10}$, $R_{20}$ and $R_{30}$.

Examples of the groups represented by L include the same groups as given for $R_{10}$, $R_{20}$ and $R_{30}$, when m represents 1. When m represents an integer of 2 or more, they include, in addition to the above, polymethylene groups such as trimethylene, tetra-methylene, hexamethylene, pentamethylene, octamethylene and dodecamethylene groups; arylene groups such as phenylene, biphenylene and naphthylene groups; multivalent alkylene groups such as trimethylenemethyl and tetramethylenemethyl groups; and multivalent arylene groups such as phenylene-1,3,5-toluyl and phenylene-1,2,4,5-tetrayl.

Examples of the counter anion represented by $X^{n-}$ include halogen ions such as chlorine, bromine and iodine ions; carboxylate ions such as acetate, oxalate, fumarate and benzoate ions; sulfonate ions such as p-toluenesulfonate, methanesulfonate, butanesulfonate and benzenesulfonate ions; a sulfuric acid ion; a perchloric acid ion; a carbonic acid ion; and a nitric acid ion.

In general formula (A-1), $R_{10}$, $R_{20}$ and $R_{30}$ are preferably groups each having 20 or less carbon atoms. When Q represents a phosphorus atom, an aryl group having 15 or less carbon atoms is particularly preferred, and when Q represents a nitrogen atom, an alkyl, aralkyl or aryl group having 15 or less carbon atoms is particularly preferred. m is preferably 1 or 2. When m represents 1, L is preferably a group having 20 or less carbon atoms, and particularly preferably an alkyl, aralkyl or aryl group having 15 or less carbon atoms. When m represents 2, the divalent organic group represented by L is preferably an alkylene group, an arylene group, an aralkylene group, or a divalent group formed by combining these groups with —CO—, —O—, N(NR')— (wherein NR' represents a hydrogen atom or the same group as given for $R_{10}$, $R_{20}$ and $R_{30}$, and when a plurality of NR' groups exist in a molecule, they may be the same or different, and may combine with each other), —S—, —SO— and —$SO_2$— groups. When m represents 2, L is preferably a divalent group having 20 or less carbon atoms bonded to $Q^+$ at its carbon atom. When m represents an integer of 2 or more, $R_{10}$, $R_{20}$ and $R_{30}$ each is plurally present, and each of plural $R_{10}$, plural $R_{20}$ and plural $R_{30}$ may be the same or different.

The counter anion represented by $X^{n-}$ is preferably a halogen ion, a carboxylate ion, a sulfonate ion or a sulfuric acid ion, and n is preferably 1 or 2.

Many of the compounds of the present invention represented by general formula (A-1) are known and commercially available as reagents. When Q is a phosphorus atom, general synthesis methods include methods of reacting a phosphinic acid derivative with an alkylating agent such as an alkyl halide or a sulfonate, and methods of normally exchanging a counter anion of a phosphonium salt. When Q is a nitrogen atom, there is the method of reacting a primary, secondary or tertiary amino compound with an alkylating agent such as an alkyl halide or a sulfonate.

Specific examples of the compounds represented by general formula (A-1) are enumerated below, but the present invention is not limited thereto.
A-1
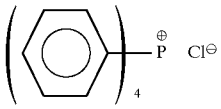
A-2
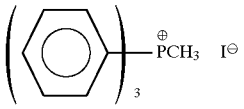
A-3
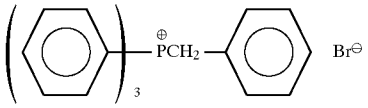
A-4
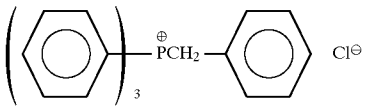
A-5
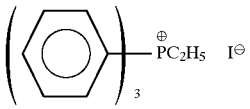
A-6
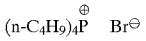
A-7
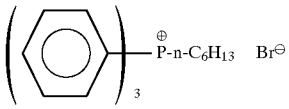
A-8
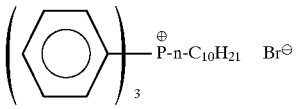
A-9
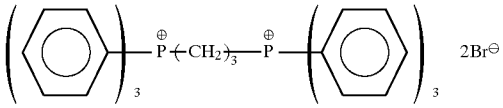
A-10
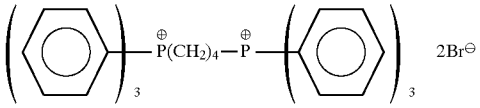
A-11
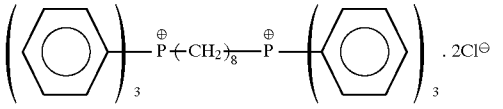
A-12
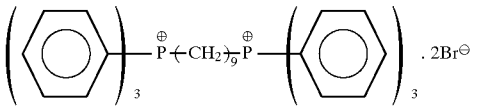
A-13
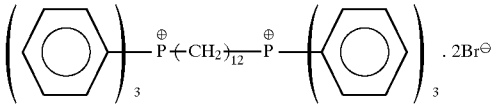
A-14
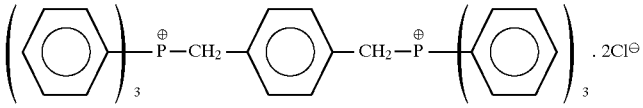

-continued
A-15
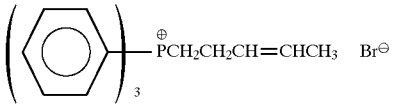
A-16
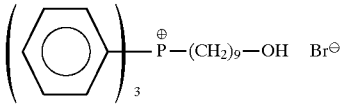
A-17
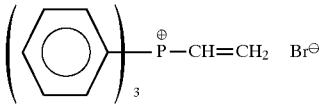
A-18
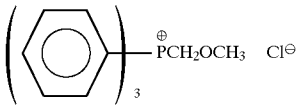
A-19
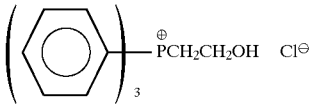
A-20
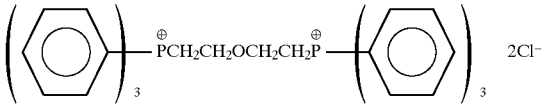
A-21
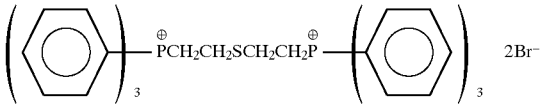
A-22
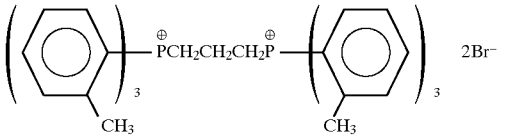
A-23
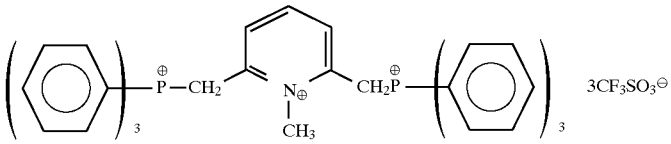
A-24
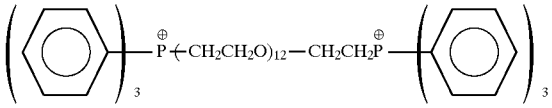
A-25
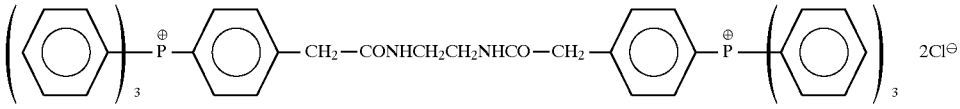
A-26
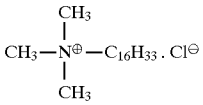
A-27
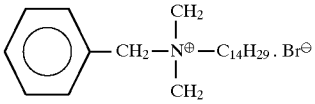
A-28
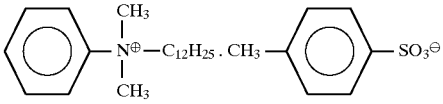

-continued
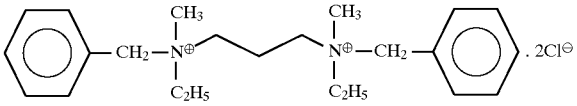
A-29
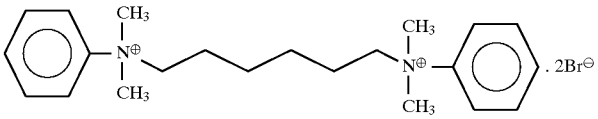
A-30
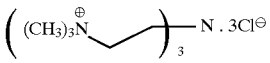
A-31
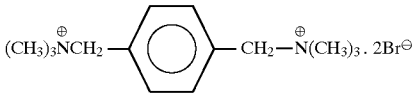
A-32
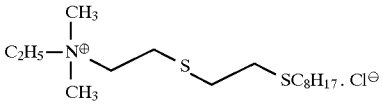
A-33
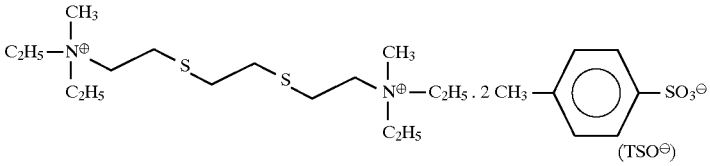
A-34
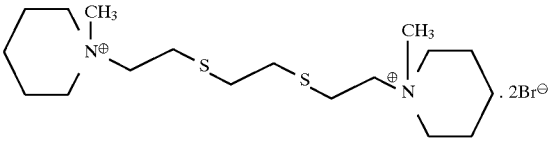
A-35
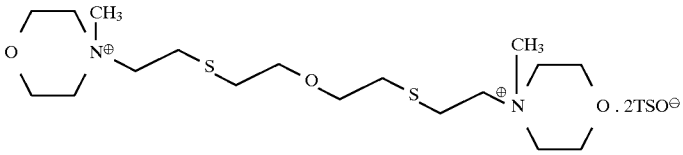
A-36
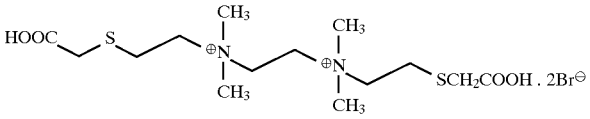
A-37
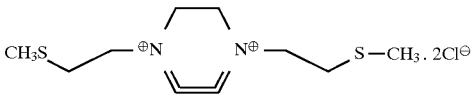
A-38
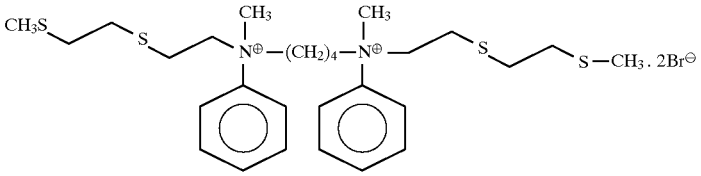
A-39
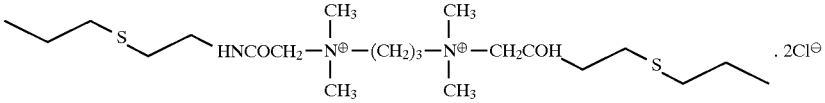
A-40

-continued

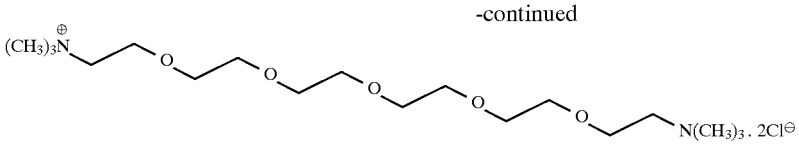

A-41

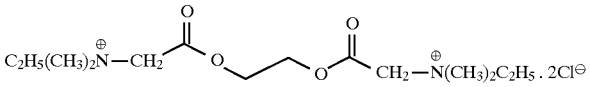

A-42

Then, general formulas (A-2) and (A-3) are described in more detail.

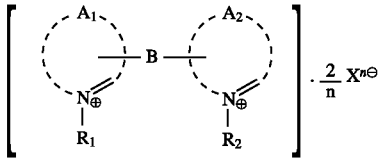

(A-2)

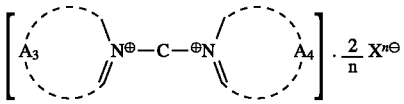

(A-3)

wherein $A_1$, $A_2$, $A_3$ and $A_4$ each represents an organic residue containing a quaternized nitrogen atom, for completing a substituted or unsubstituted unsaturated heterocyclic ring, and they may contain a carbon atom, a hydrogen atom, an oxygen atom, a nitrogen atom or a sulfur atom, and further may be condensed with a benzene ring. Examples of the unsaturated heterocyclic rings formed by $A_1$, $A_2$, $A_3$ and $A_4$ include pyridine, quinoline, isoquinoline, imidazole, thiazole, thiadiazole, benzotriazole, benzothiazole, pyrimidine and pyrazole rings. Of these, pyridine, quinoline and isoquinoline rings are particularly preferred.

The divalent groups represented by B and C are preferably alkylene, arylene, alkenylene, alkynylene, —$SO_2$—, —SO—, —O—, —S—, —N($R_N$)—, —C═O— and —P═O—, which may be alone or a combination of two or more thereof, wherein $R_N$ represents an alkyl group, an aralkyl group, an aryl group or a hydrogen atom. Particularly preferred examples thereof include alkylene, arylene, —C═O—, —O—, —S— and —N($R_N$)—, which may be alone or a combination of two or more thereof.

$R_1$ and $R_2$, which may be the same or different, are preferably alkyl groups each having 1 to 20 carbon atoms. The alkyl group may be substituted by a substituent group, and examples thereof include halogen atoms (for example, chlorine and bromine), substituted or unsubstituted alkyl (for example, methyl and hydroxyethyl), substituted or unsubstituted aryl (for example, phenyl, tolyl and p-chlorophenyl), substituted or unsubstituted acyl (for example, benzoyl, p-bromobenzoyl and acetyl), (alkyl or aryl)oxycarbonyl, sulfo (including sulfonates), carboxyl (including carboxylates), mercapto, hydroxyl, alkoxyl (for example, methoxy and ethoxy), aryloxy, carbonamido, sulfonamido, sulfamoyl, carbamoyl, ureido, thioureido, (alkyl or aryl)amino, cyano, nitro, alkylthio and arylthio groups.

Particularly preferably, $R_1$ and $R_2$ are each an alkyl group having 1 to 10 carbon atoms. Preferred examples of the substituent group include carbamoyl, oxycarbonyl, acyl, aryl, sulfo (including sulfonates), carboxyl (including carboxylates) and hydroxyl groups.

The unsaturated heterocyclic ring formed by $A_1$, $A_2$, $A_3$ and $A_4$ together with the quaternized nitrogen atom may have a substituent group. The substituent group for use herein is selected, for example, from the substituent groups described above as the substituent group for the alkyl groups represented by $R_1$ and $R_2$. Preferred examples of the substituent group include aryl, alkyl, carbamoyl, (alkyl or aryl)amino, oxycarbonyl, alkoxyl, aryloxy, (alkyl or aryl) thio, hydroxyl, carbonamido, sulfonamido, sulfo (including sulfonates) and carboxyl (including carboxylates) groups, each of which has 0 to 10 carbon atoms.

The counter anion represented by $X^{n-}$ is the same as that in general formula (A-1), and preferred examples thereof is also the same.

Although the compound for use in the present invention can be readily synthesized by generally well-known methods, *Quart. Rev.,* 16, 163 (1962) provides useful information.

Specific examples of the compounds represented by general formulas (A-2) and (A-3) are shown below, but the present invention is not limited thereto.

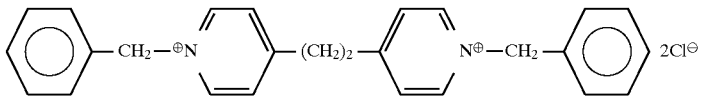

B-1

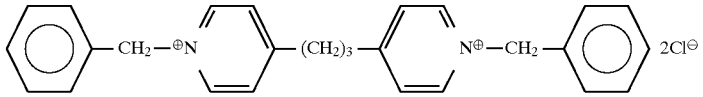

B-2

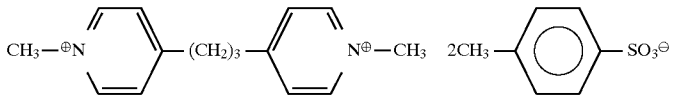

B-3

-continued
B-4
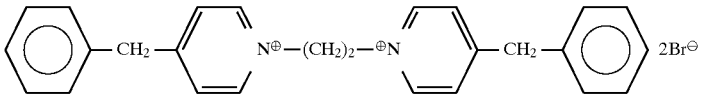
B-5
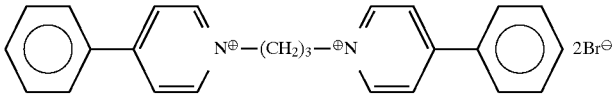
B-6
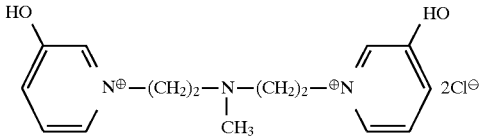
B-7
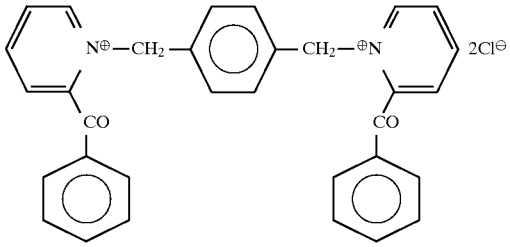
B-8
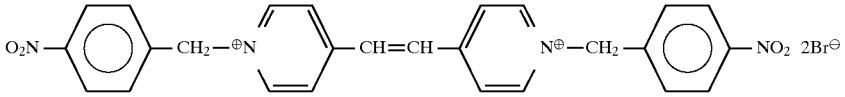
B-9
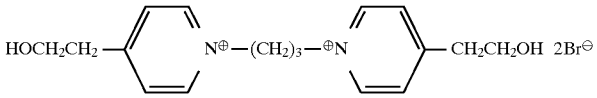
B-10
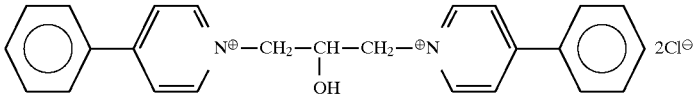
B-11
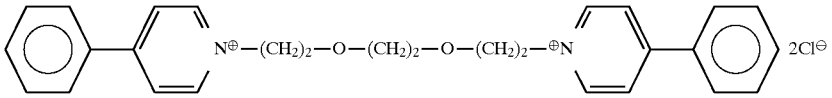
B-12
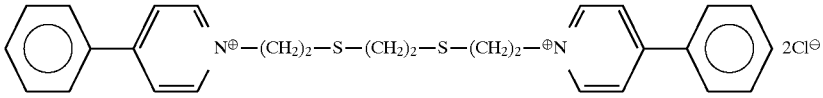
B-13
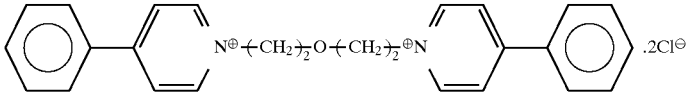
B-14
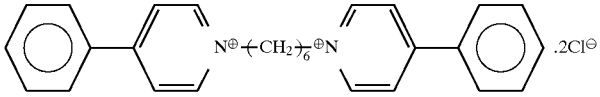
B-15
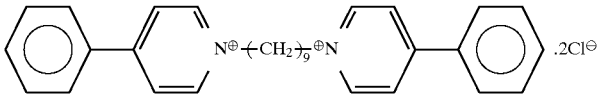
B-16
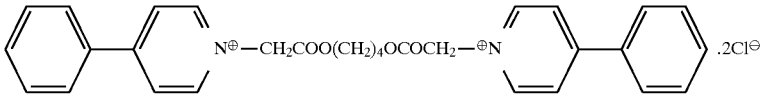

-continued
B-17
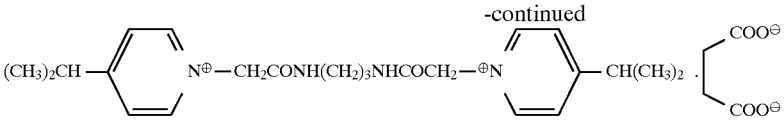
B-18
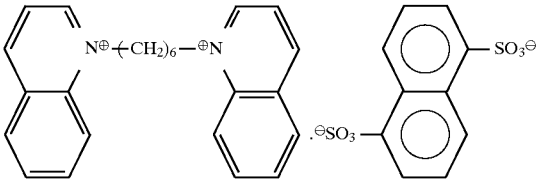
B-19
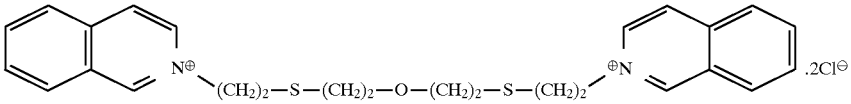
B-20
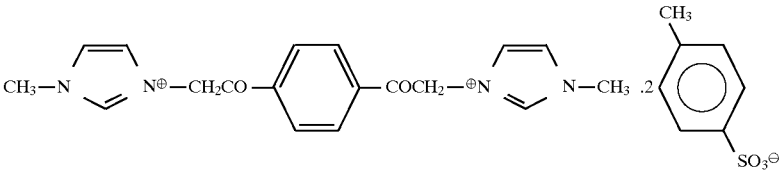
B-21
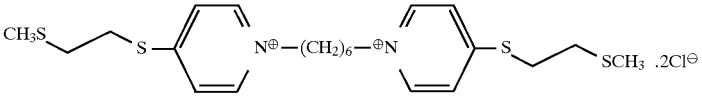
B-22
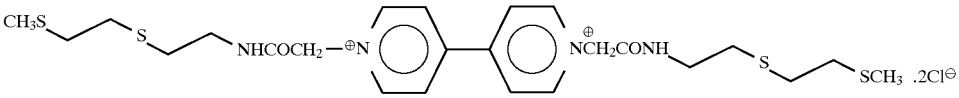
B-23
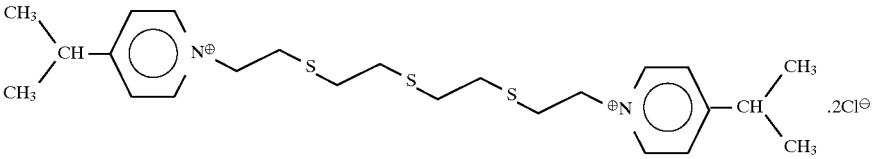
B-24
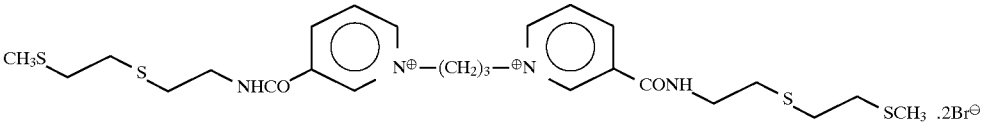
B-25
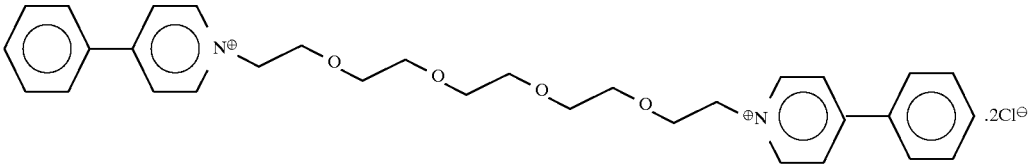
B-26
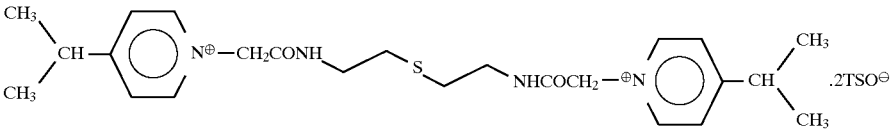
B-27
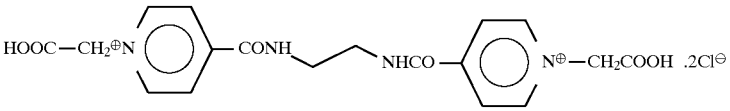

General formula (A-4) is described below.

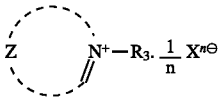

(A-4)

The nitrogen-containing unsaturated heterocyclic ring containing Z may further contain a carbon atom, a hydrogen atom, an oxygen atom or a sulfur atom in addition to the nitrogen atom, and further may be condensed with a benzene ring. Furthermore, the nitrogen-containing unsaturated heterocyclic ring may have a substituent. Examples of the heterocyclic ring formed include the nitrogen-containing unsaturated heterocyclic rings formed by $A_1$, $A_2$, $A_3$ or $A_4$ in general formulas (A-2) and (A-3), and preferred examples thereof are also the same. Pyridine, quinoline and isoquinoline rings are preferred.

When the nitrogen-containing unsaturated heterocyclic rings containing Z have a substituent group, examples of the substituent group include those exemplified as the substituent for the nitrogen-containing unsaturated heterocyclic rings formed by $A_1$, $A_2$, $A_3$ or $A_4$ in general formulas (A-2) and (A-3), and preferred examples thereof are also the same.

$R_3$ represents an alkyl group or an aralkyl group, which has 1 to 20 carbon atoms, may be substituted or unsubstituted, and may be straight chain, branched or cyclic. Examples of the substituent group include those exemplified as the substituent for the alkyl groups represented by RI and $R_2$ general formula (A-2), and preferred examples thereof are also the same.

The counter anion represented by $X^{n-}$ is the same as that in general formula (A-1), and preferred examples thereof is also the same.

Although the compounds for use in the present invention represented by general formula (A-4) can be readily synthesized by generally well-known methods, *Quart. Rev.,* 16, 163 (1962) provides useful information.

Specific examples of the compound represented by general formulas (A-4) are shown below, but the present invention is not limited thereto.

C-1

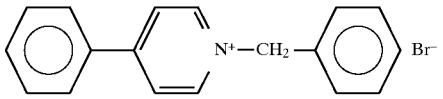

C-2

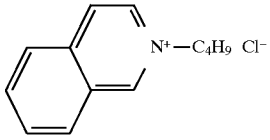

C-3

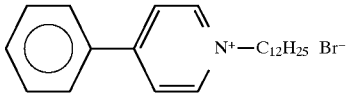

C-4

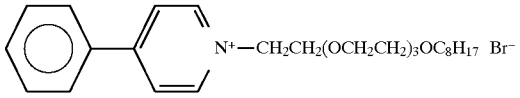

C-5

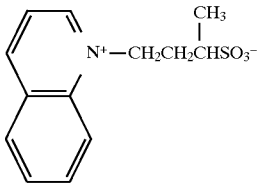

C-6

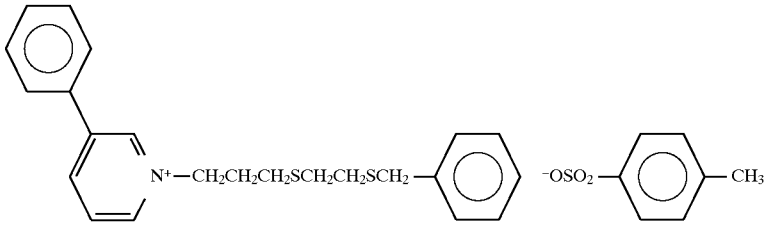

C-7

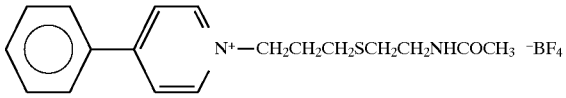

C-8

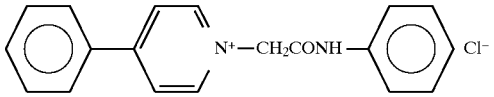

-continued

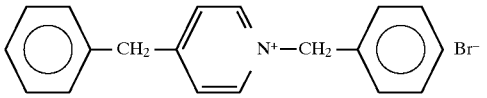

C-9

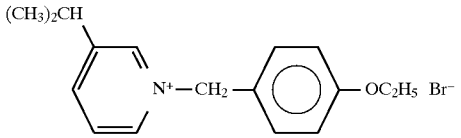

C-10

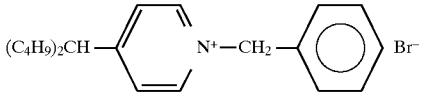

C-11

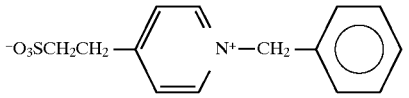

C-12

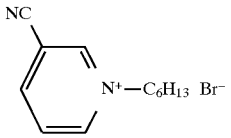

C-13

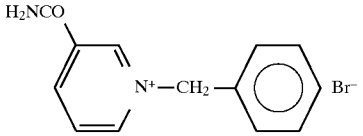

C-14

The nucleating accelerator for use in the present invention is particularly preferably a compound of onium salt type described above. However, amino compounds may also be used as the nucleating accelerator. Specifically, the following compounds are preferably used.

Compounds represented by (KA 21), (KA 22) and (KA 23) described in JP-A-7-84331, specifically, compounds described on pages 6 to 8 thereof; compounds represented by general formula [Na] described in JP-A-7-104426, specifically, compounds Na-1 to Na-22 described on pages 16 to 20 thereof; and compounds represented by general formulas (1) to (7) described in JP-A-8-272023, specifically, compounds 1-1 to 1-19, 2-1 to 2-22, 3-1 to 3-36, 4-1 to 4-5, 5-1 to 5-41, to 6-58 and 7-1 to 7-38 described therein.

In the present invention, the nucleating accelerator can be used by dissolving it in an appropriate water-miscible organic solvent, for example, alcohols (such as methanol, ethanol, propanol and fluorinated alcohol), ketones (such as acetone and methyl ethyl ketone), dimethylformamide, dimethyl sulfoxide and methyl cellosolve.

Further, by emulsifying dispersion methods already well known, the nucleating accelerator can also be dissolved using an oil such as dibutyl phthalate, tricresyl phosphate, glyceryl triacetate and diethyl phthalate, or using an auxiliary solvent such as ethyl acetate and cyclohexanone to mechanically prepare an emulsified dispersion to be used. Alternatively, the nucleating accelerator can also be used by dispersing the powder thereof in water using a ball mill, a colloid mill or ultrasonic waves.

In the present invention, the nucleating accelerator may be added to any of silver halide emulsion layer(s) and other hydrophilic colloidal layers on the silver halide emulsion layer side of the support. However, the nucleating accelerator is preferably added to the silver halide emulsion layer(s) or hydrophilic colloidal layers adjacent thereto.

In the present invention, the addition amount of the nucleating accelerator is preferably $1\times10^{-6}$ to $2\times10^{-2}$ mol, more preferably $1\times10^{-5}$ to $2\times10^{-2}$ mol, and most preferably $2\times10^{-5}$ to $1\times10^{-2}$ mol, per mol of silver halide.

The silver halide of the silver halide emulsion for use in the present invention may be any of silver chloride, silver bromide, silver chlorobromide, silver chloroiodobromide and silver iodobromide. However, the silver chloride content in the silver halide is preferably 30 mol % or more, and more preferably 50 mol % or more. Further, the silver iodide content is preferably less than 5 mol %, and more preferably less than 2 mol %.

Although the silver halide grains may have any of the cubic, tetradecahedral, octahedral, irregular and tabular forms, the cubic and tabular forms are preferred.

The photographic emulsion for use in the present invention can be prepared by the methods described in P. Glafkides, *Chimie et Physique Photographique* (Paul Montel, 1967), G. F. Dufin, *Photographic Emulsion Chemistry* (The Focal Press, 1966) and V. L. Zelikman et al., *Making and Coating Photographic Emulsion* (The Focal Press, 1964).

That is, either the acidic process or the neutral process may be employed, and a soluble silver salt and a soluble halogen salt may be reacted with each other by using any of the single jet process, the double jet process and a combination thereof.

A process in which grains are formed in the presence of excess silver ions (so-called reverse mixing process) can also be used. As a type of double jet process, there can also be used a process for maintaining the pAg in a liquid phase, in which a silver halide is formed, in constant, namely the so-called controlled double jet process. Further, it is preferred that so-called solvents for silver halides such as ammonium, thioether and tetra-substituted thiourea are used to form grains. More preferably, tetra-substituted thiourea compounds are used, as described in JP-A-53-82408 and JP-A-55-77737. Preferred examples of the thiourea compounds are tetramethylthiourea and 1,3-dimethyl-2-imidazolidine-thione. The addition amount of the solvent for silver halide is preferably $10^{31\ 5}$ to $10^{-2}$ mol per mol of silver halide, although it varies depending on the intended grain size and halogen composition.

According to the controlled double jet process and the grain forming process using the solvent for silver halide, silver halide emulsions having a regular crystal form and a narrow grain size distribution can be readily prepared. These processes are useful means for preparing the silver halide emulsion for use in the present invention.

Further, in order to homogenize the grain size, grains are preferably allowed to rapidly grow within the range not exceeding the critical degree of saturation by the method of changing the addition rate of silver nitrate and alkali halides depending on the growth speed of grains as described in British Patent 1,535,016, JP-B-48-36890 (the term "JP-B" as used herein means an "examined Japanese patent publication") and JP-B-52-16364, or by the method of changing the concentration of an aqueous solution as described in British Patent 4,242,445 and JP-A-55-158124.

The emulsion for use in the present invention is preferably a monodisperse emulsion, and the coefficient of variation thereof expressed by {(standard deviation of grain size)/(mean grain size)}×100 is 20% or less, and more preferably 15% or less.

The mean grain size of the grains contained in the silver halide emulsion is 0.5 $\mu$m or less, and particularly preferably 0.1 $\mu$m to 0.4 $\mu$m.

The silver halide emulsion for use in the present invention may contain a metal belonging to group VIII. In particular, a photographic material suitable for high illumination exposure such as scanner exposure and a photographic material for line camera work preferably contain a rhodium compound, an iridium compound, a ruthenium compound or the like in order to achieve high contrast and low fog. Furthermore, these photographic materials preferably contain an iron compound for enhancing their sensitivity.

As the rhodium compound for use in the present invention, water-soluble rhodium compounds can be used. Examples thereof include rhodium (III) halide compounds and rhodium complex salts having a halogen, an amine, an oxalato or the like as a ligand, for example, hexachlororhodium (III) complex salts, hexabromorhodium (III) complex salts, hexaaminerhodium (III) complex salts and trioxalatorhodium (III) complex salts. These rhodium compounds are dissolved in water or an appropriate solvent to use them. Commonly well-used methods for stabilizing a solution of a rhodium compound, that is, the method of adding an aqueous solution of a hydrogen halide (for example, hydrochloric acid, hydrobromic acid or hydrofluoric acid) or an alkali halide (for example, KCl, NaCl, KBr or NaBr) can be used. Instead of use of the water-soluble rhodium, it is also possible to add and dissolve other silver halide grains previously doped with rhodium in preparing the silver halide.

The iridium compound for use in the present invention include hexachloroiridium, hexabromoiridium and hexaamineiridium. The ruthenium compound for use in the present invention include hexachlororuthenium and pentachloronitrosylruthenium. The iron compound for use in the present invention include potassium hexacyanoferrate (III) and ferrous thiocyanate.

The addition amount of these compounds is $1\times10^{-8}$ to $5\times10^{-6}$ mol, and preferably $5\times10^{-8}$ to $1\times10^{-6}$ mol, per mol of silver contained in the silver halide emulsion.

Addition of these compounds can be appropriately conducted in preparing the silver halide emulsion grains or in any stage prior to coating of the emulsions. In particular, the compounds are preferably added in forming the emulsion to incorporate them into the silver halide grains.

The silver halide emulsion for use in the present invention are preferably subjected to chemical sensitization. As the chemical sensitization method, known methods such as a sulfur sensitization, a selenium sensitization, a tellurium sensitization and a noble metal sensitization can be used alone or in combination. In particular, a selenium sensitization and a tellurium sensitization are preferably used in the present invention. When they are used in combination, for example, a combination of a sulfur sensitization and a gold sensitization; a combination of a sulfur sensitization, a selenium sensitization and a gold sensitization; and a combination of a sulfur sensitization, a tellurium sensitization and a gold sensitization are preferred. In particular, a combination of a sulfur sensitization, a selenium sensitization and a gold sensitization; and a combination of a sulfur sensitization, a tellurium sensitization and a gold sensitization are preferred.

The sulfur sensitization for use in the present invention is usually conducted by adding a sulfur sensitizer and stirring an emulsion at a high temperature not less than 40° C. for a definite period of time. As the sulfur sensitizer, known compounds can be used. Examples thereof include various sulfur compounds such as thiosulfates, thiourea compounds, thiazole compounds and rhodanine compounds, as well as sulfur compounds contained in gelatin. Preferred sulfur compounds are thiosulfates and thiourea compounds. Although the addition amount of the sulfur sensitizer varies depending on various conditions such as the pH and the temperature in chemical ripening, and the size of silver halide grains, it is generally from $10^{-7}$ to $10^{-2}$ mol, and more preferably $10^{-5}$ to $10^{-3}$ mol, per mol of silver halide.

In the present invention, known selenium compounds can be used as the selenium sensitizer. That is, the selenium sensitization is usually conducted by adding an unstable type and/or non-unstable type selenium compound and stirring an emulsion at a high temperature of 40° C. or more, for a definite period of time. As the unstable type selenium compound, compounds described in JP-B-44-15748, JP-B-43-13489, JP-A-4-25832, JP-A-4-109240 and JP-A-4-324855 can be used. In particular, compounds represented by general formulas (VIII) and (IX) described in JP-A-4-324855 are preferably used.

A tellurium sensitizer for use in the present invention is a compound which produces silver telluride presumed to form a sensitizing nucleus on the surface of or inside of a silver halide grain. The forming rate of silver telluride in the silver halide emulsion can be tested by the method described in JP-A-5-313284.

Specifically, compounds described in U.S. Pat. Nos. 1,623,499, 3,320,069 and 3,772,031, British Patents 235, 211, 1,121,496, 1,295,462 and 1,396,696, Canadian Patent 800,958, JP-A-4-204640, JP-A-4-271341, JP-A-4-333043, JP-A-5-303157, *J. Chem. Soc. Chem. Commun.*, 635 (1980), ibid., 1102 (1979), ibid., 645 (1979), *J. Chem. Soc. Perkin. Trans.*, 1, 2191 (1980), *The Chemistry of Organic Selenium and Tellurium Compounds*, vol.1, edited by S. Patai (1986) and ibid. vol. 2 (1987) can be used. In particular, compounds represented by general formulas (II), (III) and (IV) in JP-A-5-313284 are preferred.

The use amount of the selenium and tellurium sensitizers for use in the present invention is generally from $10^{-8}$ to $10^{-2}$ mol, and preferably from about $10^{-7}$ to about $10^{-3}$ mol, per mol of silver halide, although it varies depending on silver halide grains used, chemical ripening conditions and the like. There is no particular limitation on the conditions of chemical sensitization in the present invention. However, the pH is generally from 5 to 8, the pAg is generally from 6 to 11 and preferably 7 to 10, and the temperature is generally from 40° to 95° C. and preferably from 45° to 85° C.

A noble metal sensitizer for use in the present invention include gold, platinum, palladium and iridium, and particularly, a gold sensitization is preferred. Examples of a gold sensitizer for use in the present invention include chloroauric acid, potassium chloroaurate, potassium aurithiocyanate and gold sulfide. They can be used in an amount of from about $10^{-7}$ to about $10^{-2}$ mol/mol of silver halide.

In the course of the formation of the silver halide grains and physical ripening, cadmium salts, sulfites, lead salts and thallium salts may be allowed to coexist with the silver halide emulsions for use in the present invention.

In the present invention, a reduction sensitization can be used. As a reduction sensitizer, stannous salts, amines, formamidinesulfinic acid and silane compounds can be used.

Thiosulfonic acid compounds may be added to the silver halide emulsions for use in the present invention by the method shown in EP-293,917.

The silver halide emulsion in the photographic material for use in the present invention may be used alone or in combination (for example, emulsions different in mean grain size, emulsions different in halogen composition emulsions different in crystal habit, and emulsions different in the conditions of chemical sensitization).

In the present invention, a silver halide emulsion particularly suitable for a photographic material for dot to dot work comprise a silver halide containing 90 mol % or more, more preferably 95 mol % or more, of silver chloride, or a silver chlorobromide or silver chloroiodobromide containing 0 to 10 mol % of silver bromide. An increase in the proportion of silver bromide or silver iodide unfavorably deteriorates safelight safety in an illuminated room or decreases γ.

Further, a silver halide emulsion for use in the photographic material for dot to dot work in the present invention preferably contains a complex of a transition metal. The transition metal includes Rh, Ru, Re, Os, Ir and Cr.

Examples of the ligand include nitrosyl and thionitrosyl ligands, halide ligands (fluorides, chlorides, bromides and iodides), cyanide ligands, cyanate ligands, thiocyanate ligands, selenocyanate ligands, tellurocyanate ligands, acido ligands and aquo ligands. When an aquo ligand exist, one or two ligands are preferably occupied by the aquo ligand.

Specifically, a rhodium atom can be incorporated by adding it in the form of a metal salt of any form such as a single salt or a complex salt in preparing the grains.

Examples of the rhodium salt include rhodium monochloride, rhodium dichloride, rhodium trichloride and ammonium hexachlororhodate, and preferably water-soluble halogen complex compounds of trivalent rhodium, for example, hexachlorhodic (III) acid or salts thereof (such as ammonium salts, sodium salts and potassium salts).

These water-soluble rhodium salts are added in an amount ranging from $1.0\times10^{-6}$ mol to $1.0\times10^{-3}$ mol, preferably from $5.0\times10^{-5}$ mol to $5.0\times10^{-4}$ mol, and more preferably from $5.0\times10^{-5}$ to $5.0\times10^{-4}$ mol, per mol of silver halide.

The following complexes of transition metals are also preferred.

| | | | |
|---|---|---|---|
| 1 | $[Ru(NO)Cl_5]^{2-}$ | 2 | $[Ru(NO)_2Cl_4]^{1-}$ |
| 3 | $[Ru(NO)(H_2O)Cl_4]^{1-}$ | 4 | $[Ru(NS)Cl_5]^{2-}$ |
| 5 | $[Rh(NO)Cl_5]^{2-}$ | 6 | $[Re(NO)CN_5]^{2-}$ |
| 7 | $[Re(NO)ClCN_4]^{2-}$ | 8 | $[Rh(NO)_2Cl_4]^{2-}$ |
| 9 | $[Rh(NO)(H_2O)Cl_4]^{1-}$ | 10 | $[Ru(NO)CN_5]^{2-}$ |
| 11 | $[Ru(NO)Br_5]^{2-}$ | 12 | $[Rh(NS)Cl_5]^{2-}$ |
| 13 | $[Os(NO)Cl_5]^{2-}$ | 14 | $[Cr(NO)Cl_5]^{3-}$ |
| 15 | $[Re(NO)Cl_5]^{1-}$ | 16 | $[Os(NS)Cl_4(TeCN)]^{2-}$ |
| 17 | $[Ru(NS)I_5]^{2-}$ | 18 | $[Re(NS)Cl_4(SeCN)]^{2-}$ |
| 19 | $[Os(NS)Cl(SCN)_4]^{2-}$ | 20 | $[Ir(NO)Cl_5]^{2-}$ |

In the present invention, the silver halide emulsion for use in a photographic material for dot to dot work is also preferably chemically sensitized by the above described method.

There is no particular limitation on spectral sensitizing dye for use in the present invention.

Although the addition amount of the sensitizing dyes varies depending on the form and the size of silver halide grains, they are generally used in an amount ranging from $4\times10^{-6}$ to $8\times10^{-3}$ mol per mol of silver halide. For example, when the size of silver halide grains is from 0.2 μm to 1.3 μm, the addition amount is preferably within the range of $2\times10^{-7}$ to $3.5\times10^{-6}$ mol, and more preferably within the range of $6.5\times10^{-7}$ to $2.0\times10^{-6}$ mol, per $m^2$ of surface area of silver halide grain.

The light-sensitive silver halide emulsion for use in the present invention may be spectrally sensitized to blue, green, red or infrared light having relatively long wavelengths by a sensitizing dye. Examples of the sensitizing dye which can be used in the present invention include cyanine dyes, merocyanine dyes, complex cyanine dyes, complex merocyanine dyes, holopolar cyanine dyes, styryl dyes, hemicyanine dyes, oxonol dyes and hemioxonol dyes.

Useful sensitizing dyes for use in the present invention are described, for example, in *Research Disclosure*, Item 17643 IV-A, page 23 (December, 1978), ibid., Item 1831 X, page 437 (August, 1978), and literatures cited therein. In particular, sensitizing dyes having the spectral sensitivity suitable for spectral characteristics of various scanner light sources can be advantageously selected.

For example, the following sensitizing dyes are advantageously selected:

A) For argon laser light sources, simple merocyanine dyes described in JP-A-60-162247, JP-A-2-48653, U.S. Pat. No. 2,161,331, West German Patent 936,071 and JP-A-5-11389;

B) For helium-neon laser light sources, trinuclear cyanine dyes shown in JP-A-50-62425, JP-A-54-18726 and JP-A-59-102229;

C) For LED light sources and red semiconductor lasers, thiacarbocyanine dyes described in JP-B-48-42172, JP-B-51-9609, JP-B-55-39818, JP-A-62-284343 and JP-A-2-105135; and D) For infrared laser light sources, tricarbocyanine dyes described in JP-A-59-191032 and JP-A-60-80841, and dicarbocyanine dyes containing 4-quinoline nuclei described in JP-A-59-192242 and general formulas (IIIa) and (IIIb) of JP-A-3-67242.

These sensitizing dyes may be used alone or in combination. Combinations of the sensitizing dyes are often used particularly for supersensitization. The emulsion may contain a dyes having no spectral sensitizing function per se, or a substance which do not substantially absorb visible light and exhibit supersensitization, together with the sensitizing dye.

Useful sensitizing dyes, combinations of dyes exhibiting supersensitization and substances exhibiting supersensitization are described in *Research Disclosure,* 176, 17643 IV-J, page 23 (December, 1978).

For the argon light sources, dyes of S1-1 to S1-13 described in JP-A-8-278584 are preferably used.

For the helium-neon laser light sources, sensitizing dyes represented by general formula (I) described in JP-A-6-75322, page 8, the last line to page 13, line 4 are particularly preferred besides the above dyes. Further, dyes represented by general formula (I) of JP-A-6-75322 are also preferably used. Specifically, dyes of S2-1 to S2-10 described in JP-A-8-278584 are particularly preferably used.

Furthermore, sensitizing dyes represented by general formula (I) described in JP-A-7-287338, specifically dyes of I-1 to I-34 described therein, are also preferably used.

For the LED light sources and the infrared semiconductor lasers, specifically, dyes of S3-1 to S3-8 described in JP-A-8-278584 are particularly preferably used.

For the infrared semiconductor laser light sources, specifically, dyes of S4-1 to S4-9 described in JP-A-8-278584 are particularly preferably used.

For white light used for camera work, sensitizing dyes of general formula (IV) described in JP-A-7-36139 (page 20, line 14 to page 22, line 23) are preferably used. Specifically, dyes of S5-1 to S5-20 described in JP-A-8-278584 are particularly preferably used.

There is no particular limitation on various additives for use in the photographic material of the present invention. For example, the following compounds can be preferably used.

Polyhydroxybenzene compounds described in JP-A-3-39948, page 10, lower right column, line 11 to page 12, lower left column, line 5. Specifically, compounds (III)-1 to (III)-25 described therein.

Compounds substantially not having the absorption maxima in the visible region represented by general formula (I) described in JP-A-1-118832. Specifically, compounds I-1 to I-26 described therein.

Antifoggants described in JP-A-2-103536, page 17, lower right column, line 19 to page 18, upper right column, line 4.

Polymer latexes described in JP-A-2-103536, page 18, lower left column, line 12 to line 20.

Matte agents, lubricants and plasticizers described in JP-A-2-103536, page 19, upper left column, line 15 to upper right column, line 15.

Hardening agents described in JP-A-2-103536, page 18, upper right column, line 5 to line 17.

Compounds having an acid group described in JP-A-2-103536, page 17, lower right column, line 1 to page 18, upper left column, line 18.

Conductive materials described in JP-A-2-18542, page 2, lower left column, line 13 to page 3, upper right column, line 7. Specifically, metal oxides described in this publication, page 2, lower right column, line 2 to line 10, and conductive polymers of compounds P-1 to P-7 described in this publication.

Water-soluble dyes described in JP-A-2-103536, page 17, upper right column, lines 1 to 18.

Solid disperse dyes described in JP-A-2-294638 and JP-A-5-11382.

Surfactants described in JP-A-2-12236, page 9, upper right column, line 7 to lower right column, line 3. PEG surfactants described in JP-A-2-103536, page 18, lower left column, line 4 to line 7. Fluorine-containing surfactants described in JP-A-3-39948, page 12, lower left column, line 6 to page 13, lower right column, line 5. Specifically, compounds VI-1 to VI-15 described therein.

Redox compounds described in JP-A-5-274816 which can release development inhibitors by oxidation. Preferably, redox compounds represented by general formulas (R-1), (R-2) and (R-3) described therein. Specifically, compounds R-1 to R-68 described therein.

Binders described in JP-A-2-18542, page 3, lower right column, line 1 to line 20.

Supports useful for practicing this invention include, for example, baryta paper, polyethylene-coated paper, polypropylene synthetic paper, glass paper, cellulose acetate films, cellulose nitrate films and polyester films such as polyethylene terephthalate films. These supports are appropriately selected depending on the intended use of the silver halide photographic material.

The developing solution for use in processing the photographic material in the present invention can contain additives usually employed (for example, a developing agent, an alkali agent, a pH buffer, a preservative and a chelating agent). In the development processing of the present invention, any of the known methods can be used, and developing solutions known in the art can be used.

The developing agent contained in the developing solution for use in the present invention is an ascorbic acid derivative, and do not contain a dihydroxybenzene developing agent.

Preferred ascorbic acid derivative developing agents for use in the present invention are compounds represented by general formula (1):

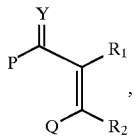

(1)

In general formula (1), $R_1$ and $R_2$ each represents a hydroxyl group, an amino group (including a group having an alkyl group of 1 to 10 carbon atoms such as methyl, ethyl, n-butyl and hydroxyethyl, as a substituent group), an acylamino group (such as acetylamino and benzoylamino), an alkylsulfonylamino group (such as methanesulfonylamino), an arylsulfonylamino group (benzenesulfonylamino and p-toluenesulfonylamino), an alkoxycarbonylamino group (methoxycarbonylamino), a mercapto group or an alkylthio group (such as methylthio or ethylthio). Preferred examples of $R_1$ and $R_2$ include hydroxyl, amino, alkylsulfonylamino and arylsulfonylamino groups.

P and Q each represents a hydroxyl group, a hydroxyalkyl group, a carboxyl group, a carboxyalkyl group, a sulfo group, a sulfoalkyl group, an amino group, an aminoalkyl group, an alkyl group, an alkoxyl group or a mercapto group, or P and Q represent atomic groups necessary for bonding each other to form a 5-, 6- or 7-membered ring together with the two vinyl carbon atoms at which $R_1$ and $R_2$ are substituted and the carbon atom at which Y is substituted. Specific examples of such a ring structure include combinations of —O—, —C($R_4$)($R_5$)—, —C($R_6$)=, —C(=O)—, —N($R_7$)— and —N=, wherein $R_4$, $R_5$, $R_6$ and $R_7$ each represents a hydrogen atom, an alkyl group having 1 to 10 carbon atoms which may be substituted (examples of the substituent group include hydroxyl, carboxyl and sulfo groups), a hydroxyl group or a carboxyl group. Further, the 5- to 7-membered rings may be condensed to form saturated or unsaturated condensed rings.

Examples of the 5- to 7-membered rings include dihydrofuranone, dihydropyrone, pyranone, cyclopentenone, cyclohexenone, pyrrolinone, pyrazolinone, pyridone, azacyclohexenone and uracil rings.. Preferred examples thereof include dihydrofuranone, cyclopentenone, cyclohexenone, pyrazolinone, azacyclohexenone and uracil rings.

=Y is a group composed of =O or =N—$R_3$, wherein $R_3$ represents a hydrogen atom, a hydroxyl group, an alkyl group (for example, methyl or ethyl), an acyl group (for example, acetyl), a hydroxyalkyl group (for example, hydroxymethyl or hydroxyethyl), a sulfoalkyl group (for example, sulfomethyl or sulfoethyl) or a carboxyalkyl group (for example, carboxymethyl or carboxyethyl).

Specific examples of the compounds represented by general formulas (1) are shown below, but the present invention is not limited thereto.

1-1

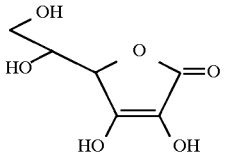

1-2

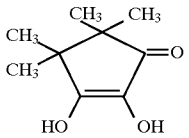

1-3

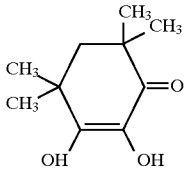

1-4

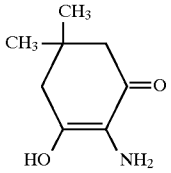

1-5

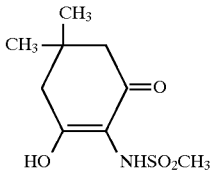

1-6

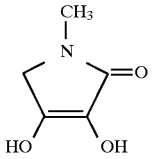

1-7

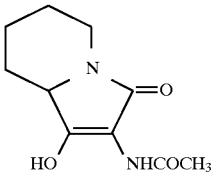

-continued 1-8

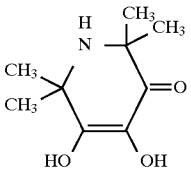

1-9

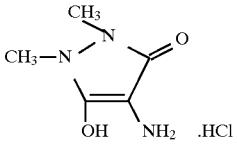

1-10

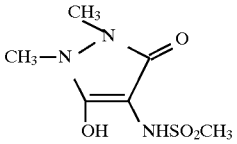

1-11

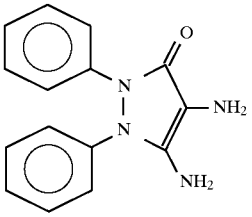

1-12

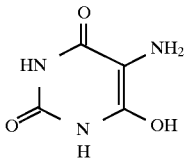

1-13

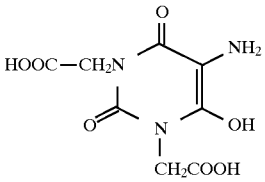

1-14

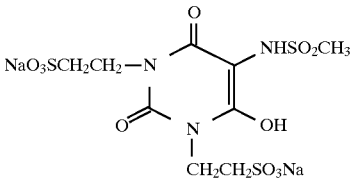

1-15

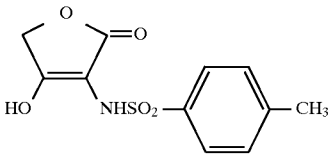

1-16

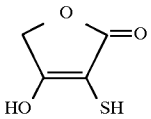

-continued 1-17

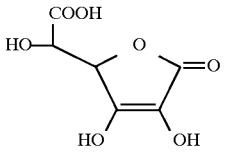

1-18

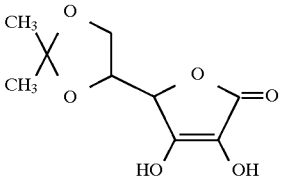

1-19

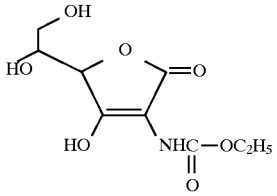

1-20

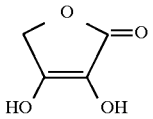

1-21

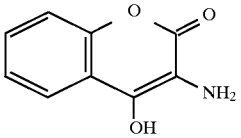

1-22

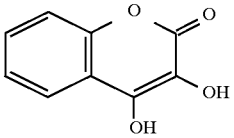

1-23

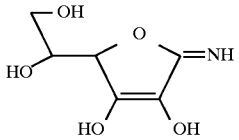

1-24

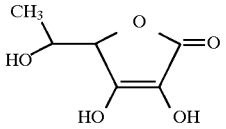

1-25

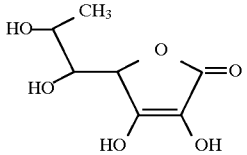

1-26

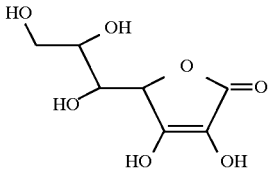

-continued 1-27

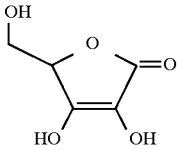

1-28

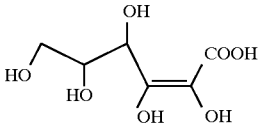

1-29

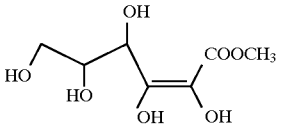

1-30

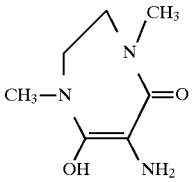

1-31

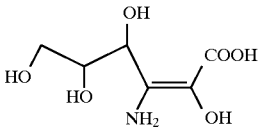

Of these, ascorbic acids and erythorbic acid (a diastereomer of ascorbic acid) are preferred.

The compounds represented by general formula (1) are used generally in an amount of $5\times10^{-3}$ to 1 mol, and preferably in an amount of $10^{-2}$ to 0.5 mol, per liter of the developing solution.

The developing solution for use in the present invention preferably contain 1-phenyl-3-pyrazolidone or a derivative thereof, or a p-aminophenol derivative as an auxiliary developing agent. Combinations of an ascorbic acid derivative and a p-aminophenol derivative are most preferred.

The 1-Phenyl-3-pyrazolidone or derivatives thereof for use in the present invention include 1-phenyl-3-pyrazolidone, 1-phenyl-4,4-dimethyl-3-pyrazolidone and 1-phenyl-4-methyl-4-hydroxymethyl-3-pyrazolidone.

The p-aminophenol derivative for use in the present invention include N-methyl-p-aminophenol, p-aminophenol, N-(β-hydroxyethyl)-p-aminophenol and N-(4-hydroxyphenyl)-glycine. Of these, N-methyl-p-aminophenol is preferred.

In general, the ascorbic acid derivative developing agent is preferably used in an amount of 0.05 mol/liter to 1.0 mol/liter, and more preferably in an amount of 0.1 mol/liter to 0.5 mol/liter. When a combination of the ascorbic acid derivative and the 1-phenyl-3-pyrazolidone or the p-aminophenol is used, the former is preferably used in an amount of 0.05 mol/liter to 1.0 mol/liter, more preferably in an amount of 0.1 mol/liter to 0.5 mol/liter, and the latter is preferably used in an amount of 0.2 mol/liter or less, more preferably in an amount of 0.1 mol/liter or less.

Examples of the preservatives for use in the present invention include sodium sulfite, potassium sulfite, lithium sulfite, ammonium sulfite, sodium bisulfite, potassium metabisulfite and sodium formaldehyde bisulfite. Preferred addition amount of the sulfite preservative is not more than 0.5 mol/liter, because too much an amount thereof causes silver contamination of the developing solution. Particularly preferred addition amount is not more than 0.1 mol/liter.

Additives for use in the present invention besides those described above include development inhibitors such as sodium bromide and potassium bromide; organic solvents such as ethylene glycol, diethylene glycol, triethylene glycol and dimethylformamide; and development accelerators such as alkanolamines such as diethanolamine and triethanolamine, and imidazole or derivatives thereof. Further, mercapto compounds, indazole compounds, benzotriazole compounds and benzoimidazole compounds may be contained as antifoggants or black pepper inhibitors. Specific examples thereof include 5-nitroindazole, 5-p-nitrobenzoylaminoindazole, 1-methyl-5-nitroindazole, 6-nitroindazole, 3-methyl-5-nitroindazole, 5-nitrobenzimidazole, 2-isopropyl-5-nitrobenzimidazole, 5-nitrobenzotriazole, sodium 4-((2-mercapto-1,3,4-thiadiazole-2-yl)thio)butanesulfonate, 5-amino-1,3,4-thiadiazole-2-thiol, methylbenzotriazole, 5-methylbenzotriazole and 2-mercaptobenzotriazole. The use amount of these antifoggants is generally 0.01 to 10 mmol, and more preferably 0.1 to 2 mmol, per liter of the developing solution.

Further, in the developing solutions for use in the present invention, various kinds of organic and inorganic chelating agents can be used alone or in combination. Sodium tetrapolyphosphate and sodium hexametaphosphate can be used as the inorganic chelating agent.

Examples of the organic chelating agent which is mainly used in the present invention include organic carboxylic acids, aminopolycarboxylic acids, organic sulfonic acids, aminosulfonic acids and organic phosphonocarboxylic acids.

Examples of the organic carboxylic acid include acrylic acid, oxalic acid, malonic acid, succinic acid, glutaric acid, adipic acid, pimelic acid, azelaic acid, sebacic acid, nonanedicarboxylic acid, decanedicarboxylic acid, undecane-dicarboxylic acid, maleic acid, itaconic acid, malic acid, citric acid and tartaric acid, but they are not limited thereto.

Examples of the aminopolycarboxylic acid include iminodiacetic acid, nitrilotriacetic acid, nitrilotripropionic acid, ethylenediaminemonohydroxy-ethyltriacetic acid, ethylenediaminetetraacetic acid, glycolethertetraacetic acid, 1,2-diaminopropanetetraacetic acid, diethylenetriaminepentaacetic acid, triethylenetetraminehexaacetic acid, 1,3-diamino-2-propanoltetraacetic acid, glycoletherdiaminetetraacetic acid and compounds described in JP-A-52-25632, JP-A-55-67747, JP-A-57-102624 and JP-B-53-40900.

Examples of the organic phosphonic acid include hydroxyalkylidene-diphosphonic acids described in U.S. Pat. Nos. 3,214,454 and 3,794,591 and West German Patent (OLS) 2,227,396, and compounds described in *Research Disclosure,* 181, Item 18170 (May, 1979).

Examples of the aminophosphonic acid include compounds described in the above described *Research Disclosure,* 18170, JP-A-57-208554, JP-A-54-61125, JP-A-55-29883 and JP-A-56-97347, as well as aminotris (methylenephosphonic acid), ethylenediaminetetramethylenephosphonic acid and aminotrimethylenephosphonic acid.

Examples of the organic phosphonocarboxylic acid include compounds described in JP-A-52-102726, JP-A-53-42730, JP-A-54-121127, JP-A-55-4024, JP-A-55-4025, JP-A-55-126241, JP-A-55-65955, JP-A-55-65956 and the above described *Research Disclosure,* 18170.

These chelating agents may be used in the form of an alkali metal salt or an ammonium salt. The addition amount of these chelating agents is preferably $1\times10^{-4}$ to $1\times10^{-1}$ mol, and more preferably $1\times10^{-3}$ to $1\times10^{-2}$ mol, per liter of the developing solution.

Further, compounds described in JP-A-56-24347, JP-B-56-45685, JP-B-62-2849 and JP-A-4-362942 can be used in the developing solution as a silver stain inhibitor.

Furthermore, compounds described in JP-A-62-212651 can be used as a developer streak inhibitor, and compounds described in JP-A-61-267759 can be used as an auxiliary solvent.

The developing solution may further contain color toning agents, surfactants, antifoaming agents and hardening agents as needed.

The development processing temperature and time are related to each other, and determined with reference to the whole processing time. The developing temperature is generally from about 20° C. to about 50° C., and preferably from 25° C. to 45° C., and the developing time is 5 seconds to 2 minutes, and preferably 7 seconds to 1 minute and 30 seconds.

In the present invention, it is preferred that the development is conducted while replenishing a developing solution and that a developing start solution and a developing replenisher each has the property such that "when 0.1 mol of sodium hydroxide is added to 1 liter of the solution, an increase in pH thereof is 0.25 or less". For confirming that the developing start solution or the developing replenisher to be used has the above property, the following method can be used. The pH of the developing start solution or the developing replenisher to be tested is adjusted to 10.0, then, 0.1 mol of sodium hydroxide is added to 1 liter of the solution, and the pH value of the solution at this time is measured. When an increase in pH value is 0.25 or less, the solution is judged to have the property defined above. In the present invention, the developing start solution and the developing replenisher each having an increase in pH value of 0.2 or less in the above described test are preferably used.

As a method for imparting the above described property to the developing start solution and the developing replenisher, the use of a buffer is preferred. The buffers used herein include carbonates, boric acid described in JP-A-62-186259, saccharides (for example, saccharose) described in JP-A-60-93433, oximes (for example, acetoxime), phenols (for example, 5-sulfosalicylic acid) and tertiary phosphates (for example, sodium salts and potassium salts), and the carbonates and boric acid are preferably used. The buffers, particularly the carbonates, are preferably used in an amount of 0.2 mol/liter or more, and particularly in an amount of 0.5 to 1.5 mol/liter.

As an alkali agent used for adjusting a pH, ordinary water-soluble inorganic alkali metal salts (for example, sodium hydroxide, potassium hydroxide, sodium carbonate and potassium carbonate) can be used.

In the present inventions the pH of the developing start solution is preferably from 8.5 to 12.0, and particularly preferably from 8.5 to 11.0. The pH of the developing replenisher and that of the developing solution in a developing tank in continuous processing is also within the above range.

When one meter square of a silver halide photographic material is processed, the replenishing rate of the developing solution is 225 ml or less, preferably 225 ml to 30 ml, and particularly preferably 180 ml to 30 ml.

The developing replenisher may have the same composition as that of the developing start solution, or may have a higher concentration than the start solution for components consumed in development. In the present invention, the pH of the developing solution decreases as the the photographic material is processed. It is therefore preferred that the pH of the developing replenisher is adjusted to a value higher than that of the developing start solution. Specifically, the pH of the developing replenisher is preferably adjusted to 0.05 to 1.0 higher, more preferably 0.1 to 0.5 higher than that of the developing start solution.

For reducing transport costs of processing solutions, packaging material costs and space, it is preferred that the processing solutions are concentrated and diluted at the time of use.

In order to reduce the exhaustion of a fixing solution caused by introduction of the developing solution into the fixing solution, the potassium ion concentration of the developing solution is preferably lowered. Specifically, it is preferred that salts added to the developing solution are all added in the form of sodium salts.

The fixing solution for use in a fixing step of the present invention is an aqueous solution containing sodium thiosulfate and ammonium thiosulfate, and, if needed, tartaric acid, citric acid, gluconic acid, boric acid, iminodiacetic acid, 5-sulfosalicylic acid, glucoheptanoic acid, Tiron, ethylenediaminetetraacetic acid, diethylenetriaminepentaacetic acid, nitrilotriacetic acid, or salts thereof. From the recent viewpoint of environmental conservation, it is preferred that boric acid is not contained.

Fixing agents of the fixing solution for use in the present invention are sodium thiosulfate, ammonium thiosulfate and the like, and ammonium thiosulfate is preferred in terms of fixing speed. However, from the recent viewpoint of environmental conservation, sodium thiosulfate may be used. The use amount of these known fixing agents can be appropriately changed, and it is generally from about 0.1 to about 2 mol/liter and preferably 0.2 to 1.5 mol/liter.

The fixing solution can contain hardening agents (for example, water-soluble aluminum compounds), preservatives (for example, sulfites and bisulfites), pH buffers (for example, acetic acid), pH regulators (for example, ammonium and sulfuric acid), chelating agents, surfactants, wetting agents and fixing accelerators, as needed.

The surfactants include, for example, anionic surfactants such as sulfated compounds and sulfonated compounds, polyethylene surfactants and amphoteric surfactants described in JP-A-57-6740. Further, known antifoaming agents may be added. The wetting agents include, for example, alkanolamines and alkylene glycols. The fixing accelerators include, for example, thiourea derivatives described in JP-B-45-35754, JP-B-58-122535 and JP-B-58-122536, alcohols having a triple bond in their molecules, thioether compounds described in U.S. Pat. No. 4,126,459 and mesoionic compounds described in JP-A-4-229860. Further, compounds described in JP-A-2-44355 may also be used.

Examples of the pH buffer include organic acids such as acetic acid, malic acid, succinic acid, tartaric acid, citric acid, oxalic acid, maleic acid, glycolic and adipic acid, and inorganic buffers such as boric acid, phosphates and sulfites. Acetic acid, tartaric acid and sulfites are preferably used.

The pH buffer is used herein for preventing the pH of the fixing agents from increasing due to introduction of the developing solution, and the use amount thereof is generally from 0.01 to 1.0 mol/liter, more preferably from 0.02 to 0.6 mol/liter.

Further, as dye elution accelerators, compounds described in JP-A-64-4739 can also be used.

The hardening agent contained in the fixing solution for use in the present invention include water-soluble aluminum salts and chromium salts. Preferred compounds are water-soluble aluminum salts, and examples thereof include aluminum chloride, aluminum sulfate and potassium alum. The addition amount thereof is preferably from 0.01 mol to 0.2 mol/liter, more preferably from 0.03 mol to 0.08 mol/liter.

The fixing temperature is generally from about 20° C. to about 50° C., preferably from 25° C. to 45° C., and the fixing time is generally from 5 seconds to 1 minute, preferably from 7 seconds to 50 seconds.

The replenishing rate of the fixing solution is 500 ml/m$^2$ or less based on the processing amount of the photographic material, and preferably 200 ml/m$^2$ or less.

The photographic material which have been developed and fixed are then subjected to washing or stabilization processing.

The washing or stabilization processing is usually conducted in a washing water amount of 20 liters or less per m$^2$ of the silver halide photographic material, and can also be conducted at a replenishing rate of 3 liters or less (including 0, namely pool washing). That is, not only water-saving processing becomes possible, but also piping for installation of an automatic processor can be made unnecessary.

As a method for decreasing the replenishing rate of the washing water, a multi-stage countercurrent system (for example, two-stage and three-stage) has been known for long. When this multi-stage countercurrent system is applied to the present invention, the photographic material after fixing is gradually processed in a normal direction, namely it successively comes into contact with the processing solution not contaminated with the fixing solution, which results in more efficient washing.

When washing is carried out with a small amount of water, it is more preferred to provide washing tanks having squeeze rolls and crossover rolls described in JP-A-63-18350 and JP-A-62-287252. In order to reduce environmental pollution load which raises a problem in washing with a small amount of water, addition of various oxidizing agents and filtration through filters may be combined therewith.

Moreover, in the method of the present invention, an overflowed solution from a washing or stabilizing bath generated by replenishment of water, which is subjected to antifungal treatment to the washing or stabilizing bath, depending on processing can also be partly or wholly utilized as a processing solution having fixing ability in the preceding processing step as described in JP-A-60-235133.

Further, in order to prevent foam spots which tends to occur in washing with a small amount of water, and/or to prevent components of processing agents adhered to the squeeze rolls from being transferred to processed films, water-soluble surfactants or antifoaming agents may be added.

Furthermore, for prevention of contamination caused by dyes eluted from the photographic material, dye adsorbents described in JP-A-63-163456 may be added to washing tanks.

Moreover, the above described washing processing is followed by stabilization processing in some cases. As an example thereof, baths containing compounds described in JP-A-2-201357, JP-A-2-132435, JP-A-1-102553 and JP-A-46-44446 may be used as a final bath for the photographic material.

Ammonium compounds, compounds of a metal such as Bi and Al, fluorescent whitening agents, various chelating agents, film pH regulators, hardening agents, disinfectants, antifungal agents, alkanolamines or surfactants can also be added to the stabilizing bath. As water used in the washing step or the stabilization step, there are preferably used deionized water and water sterilized with a halogen or ultraviolet germicidal lamp or various oxidizing agents (such as ozone, hydrogen peroxide and chlorates), as well as tap water. Washing water containing a compound described in JP-A-4-39652 and JP-A-5-241309 may also be used.

The temperature of the washing or stabilization bath is preferably from 0° C. to 50° C., and the time is preferably from 5 seconds to 2 minutes.

The processing solution for use in the present invention is preferably stored in a packing material having a low oxygen permeability, as described in JP-A-61-73147.

The processing solution for use in the present invention may be powdered or solidified. As methods thereof, known methods can be used. However, methods described in JP-A-61-259921, JP-A-4-85533 and JP-A-4-16841 are preferably used, and methods described in JP-A-61-259921 are particularly preferred.

When the replenishing rate is reduced, it is preferred to prevent evaporation and air oxidation of the solution by decreasing the contact area of the processing tank with air. Automatic developing apparatuses of roller transfer type are described in U.S. Pat. Nos. 3,025,779 and 3,545,971, and briefly referred to as roller transfer type processors in this specification. The roller transfer type processor comprises the four steps of development, fixing, washing and drying. The processing method of the present invention is also preferably follow these four steps, although not excluding another step (for example, a stop step). The four steps may be four steps having a stabilization step in place of the washing step.

The present invention will be described in more detail with reference to the following Examples, but the invention should not be construed as being limited thereto.

EXAMPLE 1

The following developing solutions were prepared:

<Developing Solution A>

| | |
|---|---|
| Diethylenetriaminepentaacetic Acid | 2 g |
| Potassium Carbonate | 33 g |
| Sodium Carbonate | 28 g |
| Sodium Hydrogencarbonate | 25 g |
| Sodium Erythorbate | 45 g |
| N-Methyl-p-aminophenol | 7.5 g |
| KBr | 2 g |
| 5-Methylbenzotriazole | 0.004 g |
| 1-Phenyl-5-mercaptotetrazole | 0.02 g |
| Sodium Sulfite | 2 g |

Water was added to make 1 liter, and the pH was adjusted to 9.7.

<Developing Solution B>

The formulation was the same as that of developing solution A, and the pH thereof was adjusted to 11.5 with NaOH.

<Developing Solution C>

| | |
|---|---|
| Diethylenetriaminepentaacetic Acid | 2 g |
| Potassium Carbonate | 16.5 g |
| Sodium Carbonate | 14 g |
| Sodium Hydrogencarbonate | 13 g |
| Hydroquinone | 23 g |
| N-Methyl-p-aminophenol | 7.5 g |
| KBr | 2 g |
| 5-Methylbenzotriazole | 0.004 g |
| 1-Phenyl-5-mercaptotetrazole | 0.02 g |
| Sodium Sulfite | 2 g |

Water was added to make 1 liter, and the pH was adjusted to 9.7.

Further, sodium hydroxide was added to developing solutions A, B and C, respectively, to increase their pH by 0.3, thereby preparing developing solutions A+, B+and C+, and acetic acid was added to developing solutions A, B and C, respectively, to reduce their PH, thereby preparing developing solutions A−, B− and C−.

<Preparation of Emulsion A)

| | |
|---|---|
| (Solution 1) | |
| Water | 1 liter |
| Gelatin | 20 g |
| Sodium Chloride | 3.0 g |
| 1,3-Dimethylimidazolidine-2-thione | 20 mg |
| Sodium Benzenesulfonate | 8 mg |
| (Solution 2) | |
| Water | 400 ml |
| Silver Nitrate | 100 g |
| (Solution 3) | |
| Water | 400 ml |
| Sodium Chloride | 27.1 g |
| Potassium Bromide | 21.0 g |
| Ammonium Hexachloroiridate (III) (0.001% aqueous solution) | 20 ml |
| Potassium Hexachlororhodate (III) (0.001% aqueous solution) | 6 ml |

Solution 2 and solution 3 were concurrently added to solution 1 maintained at 42° C. and at a pH of 4.5 with stirring over a period of 15 minutes to form nuclear grains. Subsequently, solution 4 and solution 5 were added thereto over a period of 15 minutes, and 0.15 g of potassium iodide was further added to terminate the grain formation.

| | |
|---|---|
| (Solution 4) | |
| Water | 400 ml |
| Silver Nitrate | 100 g |
| (Solution 5) | |
| Water | 400 ml |
| Sodium Chloride | 27.1 g |
| Potassium Bromide | 21.0 g |
| Potassium Hexacyanoferrate (II) (0.1% aqueous solution) | 10 ml |

Then, the grains were washed with water according to a common flocculation method, and 40 g of gelatin was added thereto.

After adjusting the pH thereof to 5.2 and the pAg thereof to 7.5, 1.0 mg of sodium thiosulfate, 4.0 mg of chloroauric acid, 1.5 mg of triphenylphosphine selenide, 8 mg of sodium benzenethiosulfonate and 2 mg of sodium benzenethiosulfinate were added to conduct chemical sensitization so as to give optimum sensitivity at 55° C.

Further, 100 mg of 4-hydroxy-6-methyl-1,3,3a,7-tetrazaindene was added as a stabilizer, and phenoxyethanol was added as a preservative to finally obtain cubic silver chloroiodobromide emulsion A having a mean grain size of 0.25 $\mu$m and a silver chloride content of 70 mol %.

<Preparation of Coated Samples>

Sensitizing dye (1) was added to emulsion A in an amount of $3.8\times10^{-4}$ mol/mol-Ag, and spectral sensitization was conducted. Further, $3.4\times10^{-4}$ mol/mol-Ag of KBr, $3.2\times10^{-4}$ mol/mol-Ag of compound (1), $8.0\times10^{-4}$ mol/mol-Ag of compound (2), $1.2\times10^{-2}$ mol/mol-Ag of hydroquinone, $3.0\times10^{-3}$ mol/mol-Ag of citric acid, $1.0\times10^{-4}$ mol/mol-Ag of each of the hydrazine derivatives as shown in Table 1, $6.0\times10^{-4}$ mol/mol-Ag of compound (3), 35% by weight based on gelatin of a polyethyl acrylate latex, 20% by weight based on gelatin of colloidal silica having a grain size of 10 μm, and 4% by weight based on gelatin of compound (4) were added thereto. Then, the thus obtained emulsion solution was applied onto a polyethylene terephthalate support so as to give an Ag coating amount of 2.5 g/m$^2$ of and a gelatin coating amount of 1.0 g/M$^2$. An upper protective layer and a lower protective layer having the following formulations, respectively, were formed thereon, and an UL layer having the following formulation was formed beneath the lower protective layer.

Further, for comparison with the hydrazine derivatives and the nucleating accelerators of the invention, the following compound was used:

Comparative Compound 1

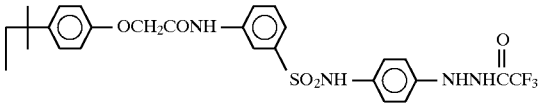

TABLE 1

| Sample No. | Hydrazine Derivative |
|---|---|
| 1-a | Comparative Compound 1 |
| 1-b | 4c |
| 1-c | 5c |
| 1-d | 12s |
| 1-e | 21 |
| 1-f | 23c |
| 1-g | 24e |
| 1-h | 25d |

| | |
|---|---|
| (Upper Protective Layer) | |
| Gelatin | 0.3 g/m$^2$ |
| Silica Matte Agent (mean grain size: 3.5 μm) | 25 mg/m$^2$ |
| Compound (5) (gelatin dispersion) | 20 mg/m$^2$ |
| Colloidal Silica (grain size: 10–20 μm) | 30 mg/m$^2$ |
| Compound (6) | 5 mg/m$^2$ |
| Sodium Dodecylbenzenesulfonate | 20 mg/m$^2$ |
| Compound (7) | 20 mg/m$^2$ |
| (Lower Protective Layer) | |
| Gelatin | 0.5 g/m$^2$ |
| Compound (8) | 15 mg/m$^2$ |
| 1,5-Dihydroxy-2-benzaldoxime | 10 mg/m$^2$ |
| Polyethyl Acrylate Latex | 150 mg/m$^2$ |
| (UL Layer) | |
| Gelatin | 0.5 g/m$^2$ |
| Polyethyl Acrylate Latex | 150 mg/m$^2$ |
| Compound (4) | 40 mg/m$^2$ |
| Compound (9) | 10 mg/m$^2$ |

The supports of the samples used in the present invention each has a back layer and a conductive layer having the following formulations, respectively.

| | |
|---|---|
| (Back Layer) | |
| Gelatin | 3.3 g/m$^2$ |
| Sodium Dodecylbenzenesulfonate | 80 mg/m$^2$ |
| Compound (10) | 40 mg/m$^2$ |
| Compound (11) | 20 mg/m$^2$ |
| Compound (12) | 90 mg/m$^2$ |
| 1,3-Divinylsulfonyl-2-propanol | 60 mg/m$^2$ |

-continued

| | |
|---|---|
| Fine Polymethyl Methacrylate (mean grain size: 6.5 μm) | 30 mg/m$^2$ |
| Compound (4) | 120 mg/m$^2$ |
| (Conductive Layer) | |
| Gelatin | 0.1 g/m$^2$ |
| Sodium Dodecylbenzenesulfonate | 40 mg/m$^2$ |
| $SnO_2$/Sb (weight ratio: 9/1, mean grain size: 0.25 μm) | 200 mg/m$^2$ |

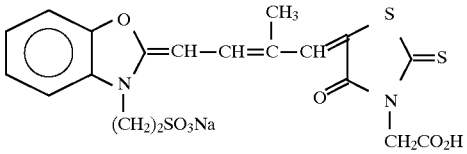

Sensitizing Dye (1)

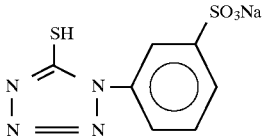

Compound (1)

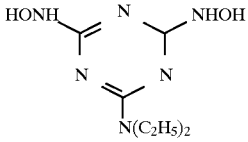

Compound (2)

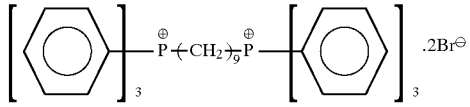

Compound (3)

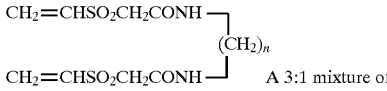

A 3:1 mixture of n = 2 and n = 3

Compound (4)

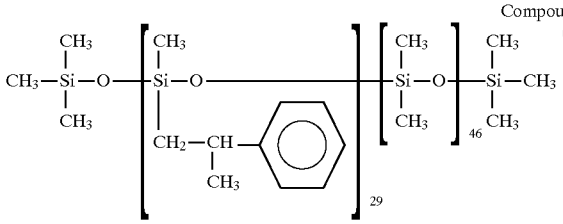

Compound (5)

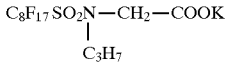

Compound (6)

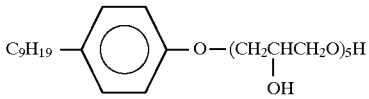

Compound (7)

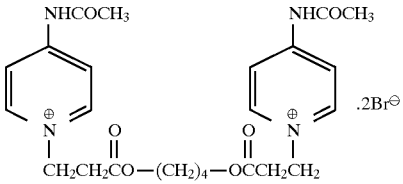

Compound (8)

-continued

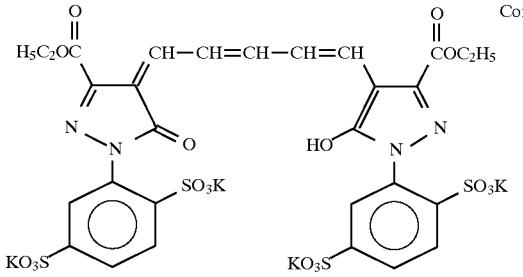

Compound (9)

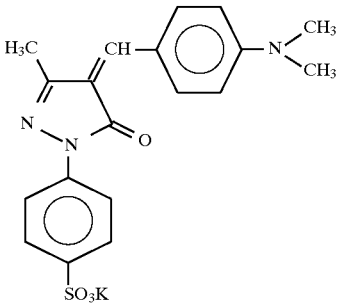

Compound (10)

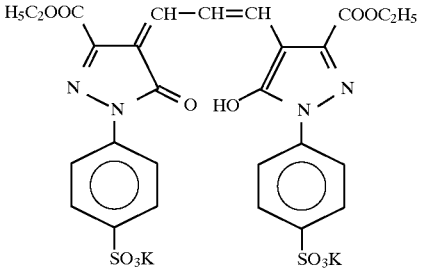

Compound (11)

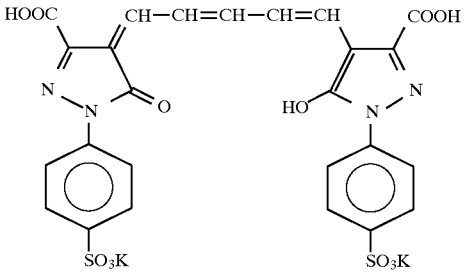

Compound (12)

<Evaluation>

(1) Exposure and Development Processing

The above described samples were exposed to xenon flash light having a light-emitting time of $10^{-5}$ second through an interference filter having a peak at 633 nm and a step wedge. The exposed samples were developed with an FG-680AG automatic processor manufactured by Fuji Photo Film Co., Ltd. at 32° C. for 15 seconds using developing solution A, B or C as described above, followed by fixing, washing and drying. The replenishing rate of the developing solution and a fixing solution are each 100 ml per $m^2$ of the sample.

As the fixing solution, a solution having the following formulation was used.

| (Fixing Solution A) | |
|---|---|
| Ammonium Thiosulfate | 120 g |
| Disodium Ethylenediaminetetraacetate Dihydrate | 0.03 g |
| Sodium Thiosulfate Pentahydrate | 11 g |
| Sodium Metasulfite | 19 g |
| Sodium Hydroxide | 12.4 g |
| Acetic Acid (100%) | 30 g |
| Tartaric Acid | 2.9 g |
| Sodium Gluconate | 1.7 g |
| Aluminum Sulfate | 8.4 g |
| pH | 4.8 |

(2) Photographic Sensitivity

The sensitivity ($S_{1.5}$) is represented by the logarithm of an exposure amount giving a density of 1.5. Smaller value shows higher sensitivity.

(3) Gamma

The slope of a straight line connecting a point of fog+0.1 (density) and a point of fog+3.0 (density) in a characteristic curve of the photographic material is expressed as the gamma value, an index showing a contrast of an image. That is, the gamma value is indicated by gamma=(3.0−0.1)/(log (an exposure amount giving a density of 3.0)−log(an exposure amount giving a density of 0.1)). Larger gamma value shows higher contrast of photographic characteristics. Practically, a gamma value of 15 or more is required.

(4) Developing Solution pH Dependency of Photographic Sensitivity

The dependency of photographic sensitivity on pH of developing solution A was calculated by the following equation:

$$\text{pH dependency } (\Delta S_{1.5}) = S_{1.5}(\text{developing solution A+}) - S_{1.5}(\text{developing solution A−})$$

Smaller value shows lower developing solution pH dependency, namely higher processing stability. For developing solutions B and C, the dependency of photographic sensitivity of pH of a developing solution was similarly calculated. Practically, a value of 0.10 or more is required.

(5) Black Peppers

An unexposed photographic material was developed with developing solutions A, B or C at 35° C. for 30 seconds, and the number of black peppers developed was visually evaluated. "5" shows the best quality, and "1" indicates the worst quality. "3" shows the practicable limitation, and "2" and "1" are not practicable.

The results of the evaluation are summarized in Table 2.

TABLE 2

| Experimental No. | Sample No. | Developing Solution No. | Gamma | pH Dependency | Black Pepper | Remark |
|---|---|---|---|---|---|---|
| 1-1 | 1-a | B | 18 | 0.20 | 1 | Comparison |
| 1-2 | 1-b | B | 21 | 0.11 | 1 | Comparison |
| 1-3 | 1-c | B | 23 | 0.12 | 1 | Comparison |

TABLE 2-continued

| Experimental No. | Sample No. | Developing Solution No. | Gamma | pH Dependency | Black Pepper | Remark |
|---|---|---|---|---|---|---|
| 1-4 | 1-a | C | 11 | 0.23 | 2 | Comparison |
| 1-5 | 1-b | C | 14 | 0.14 | 2 | Comparison |
| 1-6 | 1-c | C | 15 | 0.12 | 2 | Comparison |
| 1-7 | 1-a | A | 12 | 0.25 | 3 | Comparison |
| 1-8 | 1-b | A | 19 | 0.03 | 5 | Invention |
| 1-9 | 1-c | A | 21 | 0.01 | 5 | Invention |
| 1-10 | 1-d | A | 18 | 0.04 | 5 | Invention |
| 1-11 | 1-e | A | 18 | 0.06 | 5 | Invention |
| 1-12 | 1-f | A | 19 | 0.04 | 4 | Invention |
| 1-13 | 1-g | A | 20 | 0.05 | 4 | Invention |
| 1-14 | 1-h | A | 18 | 0.06 | 4 | Invention |

<Results>

When the photographic materials containing the hydrazine derivatives according to the present invention were combined with the developing solution according to the present invention, photographic characteristics of being low in the pH dependency of photographic sensitivity, being high in activity, and being difficult to develop black peppers were specifically obtained.

EXAMPLE 2

When the following photographic materials were used in place of the photographic materials prepared in Example 1, results similar to those of Example 1 were also obtained. These photographic materials were exposed through an interference filter having a peak at 780 nm.

<Preparation of Emulsion B>

| | |
|---|---|
| (Solution 1) | |
| Water | 1 liter |
| Gelatin | 20 g |
| Sodium Chloride | 1.5 g |
| 1,3-Dimethylimidazolidine-2-thione | 20 mg |
| Sodium Benzenesulfonate | 8 mg |
| (Solution 2) | |
| Water | 400 ml |
| Silver Nitrate | 100 g |
| (Solution 3) | |
| Water | 400 ml |
| Sodium Chloride | 27.1 g |
| Potassium Bromide | 21.0 g |
| Ammonium Hexachloroiridate (III) (0.001% aqueous solution) | 20 ml |
| Potassium Hexachlororhodate (III) (0.001% aqueous solution) | 10 ml |

Solution 2 and solution 3 were concurrently added to solution 1 maintained at 40° C. and at a pH of 4.5 with stirring over a period of 15 minutes to form nuclear grains. Subsequently, solution 4 and solution 5 were added thereto over a period of 15 minutes, and 0.15 g of potassium iodide was further added to terminate the grain formation.

| | |
|---|---|
| (Solution 4) | |
| Water | 400 ml |
| Silver Nitrate | 100 g |

-continued

| | |
|---|---|
| (Solution 5) | |
| Water | 400 ml |
| Sodium Chloride | 27.1 g |
| Potassium Bromide | 21.0 g |

Then, the grains were washed with water according to a common flocculation process, and 40 g of gelatin was added thereto.

After adjusting the pH to 5.7 and the pAg to 7.5, 1.0 mg of sodium thiosulfate, 4.0 mg of chloroauric acid, 1.5 mg of triphenylphosphine selenide, 8 mg of sodium benzenethiosulfonate and 2 mg of sodium benzenethiosulfinate were added to conduct chemical sensitization so as to give optimum sensitivity at 55° C.

Further, 100 mg of 4-hydroxy-6-methyl-1,3,3a,7-tetrazaindene was added as a stabilizer, and phenoxyethanol was added as a preservative to finally obtain cubic silver chloroiodobromide emulsion B having a mean grain size of 0.22 $\mu$m and a silver chloride content of 70 mol %.

<Preparation of Coated Samples>

Sensitizing dye (2) was added to emulsion B in an amount of $8.0\times10^{-5}$ mol/mol-Ag, and spectral sensitization was conducted. Further, $3.4\times10^{-4}$ mol/mol-Ag of KBr, $2.0\times10^{-4}$ mol/mol-Ag of compound (13), $1.0\times10^{-3}$ mol/mol-Ag of compound (14), $2.0\times10^{-2}$ mol/mol-Ag of hydroquinone, $2.0\times10^{-3}$ mol/mol-Ag of citric acid, $1.5\times10^{-4}$ mol/mol-Ag of each of the hydrazine derivatives as shown in Table 3, $9.0\times10^{-4}$ mol/mol-Ag of compound (16), $2.3\times10^{-4}$ mol/mol-Ag of compound (17), $1.4\times10^{-4}$ mol/mol-Ag of compound (18), 35% by weight based on gelatin of a polyethyl acrylate latex, 20% by weight based on gelatin of colloidal silica having a grain size of 10 $\mu$m, and 4% by weight based on gelatin of compound (19) were added thereto. Then, the thus obtained emulsion solution was applied onto a polyethylene terephthalate support so as to give an Ag coating amount of 3.25 g/m$^2$ and a gelatin coating amount of 1.4 g/m$^2$. An upper protective layer and a lower protective layer having the formulations as described below, respectively, were formed thereon.

TABLE 3

| Sample No. | Hydrazine Derivative |
|---|---|
| 2-a | Comparative Compound 1 |
| 2-b | 4c |
| 2-c | 6c |
| 2-d | 14s |

TABLE 3-continued

| Sample No. | Hydrazine Derivative |
|---|---|
| 2-e | 26c |

| (Upper Protective Layer) | |
|---|---|
| Gelatin | 0.3 g/m$^2$ |
| Silica Matte Agent (mean grain size: 3.5 $\mu$m) | 25 mg/m$^2$ |
| Compound (20) (gelatin dispersion) | 20 mg/m$^2$ |
| Colloidal Silica (grain size: 10–20 $\mu$m) | 30 mg/m$^2$ |
| Compound (21) | 5 mg/m$^2$ |
| Sodium Dodecylbenzenesulfonate | 20 mg/m$^2$ |
| Compound (22) | 20 mg/m$^2$ |
| (Lower Protective Layer) | |
| Gelatin | 0.8 g/m$^2$ |
| Compound (23) | 20 mg/m$^2$ |
| Compound (24) | 7 mg/m$^2$ |
| 1,5-Dihydroxy-2-benzaldoxime | 10 mg/m$^2$ |
| Polyethyl Acrylate Latex | 150 mg/m$^2$ |

The supports of the samples used in the present invention each has a back layer and a conductive layer having the following formulations, respectively.

| (Back Layer) | |
|---|---|
| Gelatin | 3.0 g/m$^2$ |
| Sodium Dodecylbenzenesulfonate | 40 mg/m$^2$ |
| Compound (24) | 60 mg/m$^2$ |
| Compound (25) | 30 mg/m$^2$ |
| 1,3-Divinylsulfonyl-2-propanol | 60 mg/m$^2$ |
| Fine Polymethyl Methacrylate (mean grain size: 6.5 $\mu$m) | 6 mg/m$^2$ |
| Fine Polymethyl Methacrylate (mean grain size: 3.5 $\mu$m) | 25 mg/m$^2$ |
| Sodium Sulfate | 150 mg/m$^2$ |
| Compound (19) | 110 mg/m$^2$ |
| (Conductive Layer) | |
| Gelatin | 0.1 g/m$^2$ |
| Sodium Dodecylbenzenesulfonate | 20 mg/m$^2$ |
| $SnO_2$/Sb (weight ratio: 9/1, mean grain size: 0.25 $\mu$m) | 200 mg/m$^2$ |

Sensitizing Dye (2)

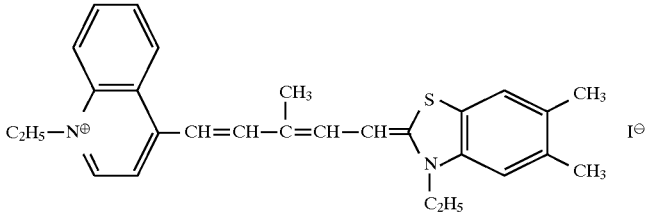

Compound (13)

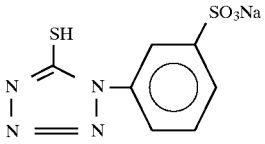

Compound (14)

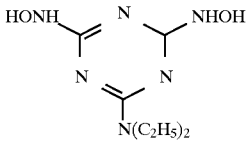

Compound (16)

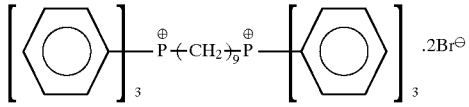

Compound (17)

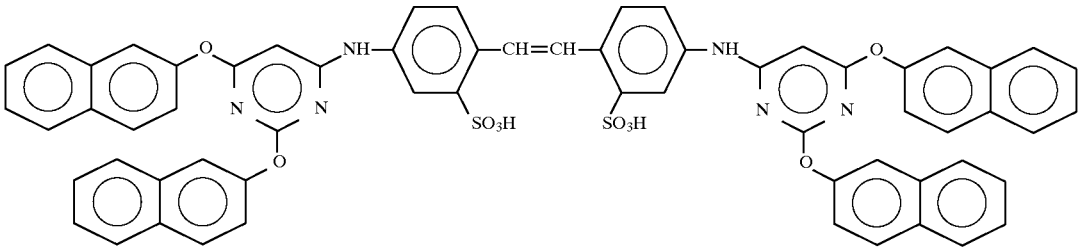

-continued

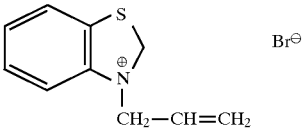

Compound (18)

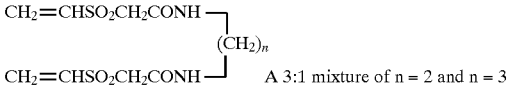

A 3:1 mixture of n = 2 and n = 3

Compound (19)

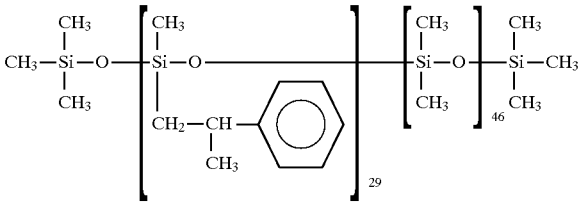

Compound (20)

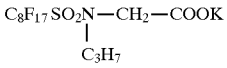

Compound (21)

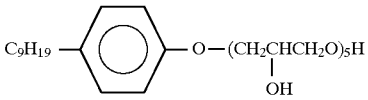

Compound (22)

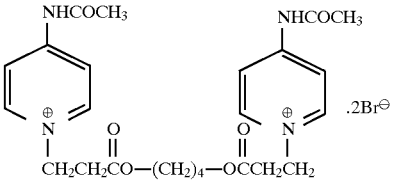

Compound (23)

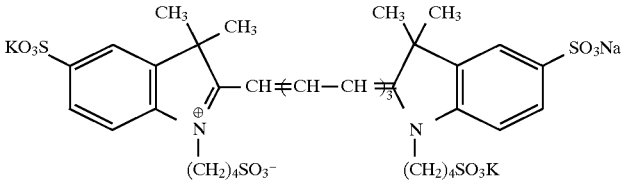

Compound (24)

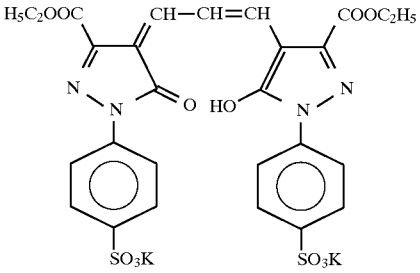

Compound (25)

EXAMPLE 3

When the following photographic materials were used in place of the photographic materials prepared in Example 1, results similar to those of Example 1 were also obtained. These photographic materials were exposed through an interference filter having a peak at 488 nm.

<Preparation of Emulsion C>

| (Solution 1) | |
|---|---|
| Water | 1 liter |
| Gelatin | 20 g |
| Sodium Chloride | 2.0 g |
| 1,3-Dimethylimidazolidine-2-thione | 20 mg |

-continued

| | |
|---|---|
| Sodium Benzenesulfonate | 8 mg |
| (Solution 2) | |
| Water | 400 ml |
| Silver Nitrate | 100 g |
| (Solution 3) | |
| Water | 400 ml |
| Sodium Chloride | 27.1 g |
| Potassium Bromide | 21.0 g |
| Ammonium Hexachloroiridate (III) (0.001% aqueous solution) | 20 ml |
| Potassium Hexachlororhodate (III) (0.001% aqueous solution) | 7 ml |

Solution 2 and solution 3 were concurrently added to solution 1 maintained at 40° C. and at a pH of 4.5 with stirring over a period of 15 minutes to form nuclear grains. Subsequently, solution 4 and solution 5 were added thereto over a period of 15 minutes, and 0.15 g of potassium iodide was further added to terminate the grain formation.

| | |
|---|---|
| (Solution 4) | |
| Water | 400 ml |
| Silver Nitrate | 100 g |
| (Solution 5) | |
| Water | 400 ml |
| Sodium Chloride | 27.1 g |
| Potassium Bromide | 21.0 g |

Then, the grains were washed with water according to a common flocculation method, and 40 g of gelatin was added thereto.

After adjusting the pH to 5.7 and the pAg to 7.5, 1.0 mg of sodium thiosulfate, 4.0 mg of chloroauric acid, 1.5 mg of triphenylphosphine selenide, 8 mg of sodium benzenethiosulfonate and 2 mg of sodium benzenethiosulfinate were added to conduct chemical sensitization so as to give optimum sensitivity at 55° C.

Further, 100 mg of 4-hydroxy-6-methyl-1,3,3a,7-tetrazaindene was added as a stabilizer, and phenoxyethanol was added as a preservative to finally obtain cubic silver chloroiodobromide emulsion C having a mean grain size of 0.23 μm and a silver chloride content of 70 mol %.

<Preparation of Coated Samples>

Sensitizing dyes (3) and (4) was added to emulsion C in an amount of $2.0\times10^{-4}$ mol/mol-Ag and $7.0\times10^{-4}$ mol/mol-Ag, respectively, and spectral sensitization was conducted. Further, $3.4\times10^{-4}$ mol/mol-Ag of KBr, $5.0\times10^{-4}$ mol/mol-Ag of compound (26), $8.0\times10^{-4}$ mol/mol-Ag of compound (27), $1.2\times10^{-2}$ mol/mol-Ag of hydroquinone, $8.0\times10^{-4}$ mol/mol-Ag of each of the hydrazine derivatives as shown in Table 4, $3.5\times10^{-4}$ mol/mol-Ag of compound (29), 30% by weight based on gelatin of a polyethyl acrylate latex, 15% by weight based on gelatin of colloidal silica having a grain size of 10 μm, and 4% by weight based on gelatin of compound (30) were added thereto. Then, the thus obtained emulsion solution was applied onto a polyethylene terephthalate support so as to give an Ag coating amount of 3.4 g/m² and a gelatin coating amount of 1.5 g/m². An upper protective layer and a lower protective layer having the formulations as described below, respectively, were formed thereon, and an UL layer having the following formulation was formed beneath the lower protective layer.

TABLE 4

| Sample No. | Hydrazine Derivative |
|---|---|
| 3-a | Comparative Compound 1 |
| 3-b | 5c |
| 3-c | 15e |
| 3-d | 23c |
| 3-e | 25c |

| | |
|---|---|
| (Upper Protective Layer) | |
| Gelatin | 0.3 g/m² |
| Silica Matte Agent (mean grain size: 3.5 μm) | 25 mg/m² |

-continued

| | |
|---|---|
| Compound (31) (gelatin dispersion) | 20 mg/m² |
| Colloidal Silica (grain size: 10–20 μm) | 30 mg/m² |
| Compound (32) | 5 mg/m² |
| Sodium Dodecylbenzenesulfonate | 20 mg/m² |
| Compound (33) | 20 mg/m² |
| (Lower Protective Layer) | |
| Gelatin | 0.5 g/m² |
| Compound (34) | 15 mg/m² |
| 1,5-Dihydroxy-2-benzaldoxime | 10 mg/m² |
| Polyethyl Acrylate Latex | 250 mg/m² |
| (UL Layer) | |
| Gelatin | 0.5 g/m² |
| Polyethyl Acrylate Latex | 150 mg/m² |
| Compound (30) | 40 mg/m² |

The supports of the samples used in the present invention each has a back layer and a conductive layer having the following formulations, respectively.

| | |
|---|---|
| (Back Layer) | |
| Gelatin | 3.3 g/m² |
| Sodium Dodecylbenzenesulfonate | 80 mg/m² |
| Compound (35) | 90 mg/m² |
| Compound (36) | 20 mg/m² |
| Compound (37) | 40 mg/m² |
| 1,3-Divinylsulfonyl-2-propanol | 60 mg/m² |
| Fine Polymethyl Methacrylate (mean grain size: 3.5 μm) | 20 mg/m² |
| Compound (30) | 120 mg/m² |
| (Conductive Layer) | |
| Gelatin | 0.1 g/m² |
| Sodium Dodecylbenzenesulfonate | 20 mg/m² |
| $SnO_2$/Sb (weight ratio: 9/1, mean grain size: 0.25 μm) | 200 mg/m² |

Sensitizing Dye (3)

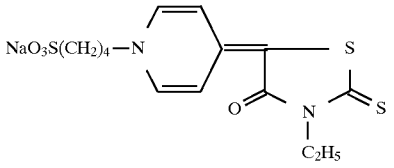

Sensitizing Dye (4)

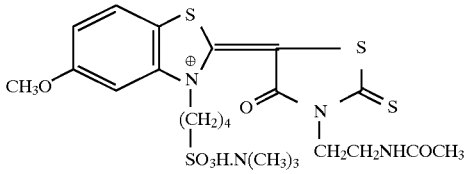

Compound (26)

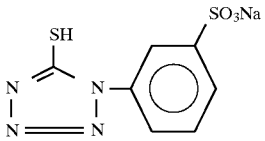

-continued

Compound (27)

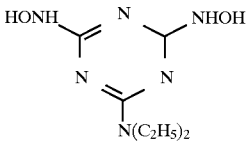

Compound (29)

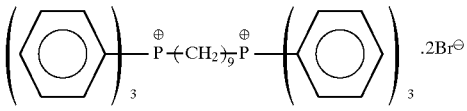

Compound (30)

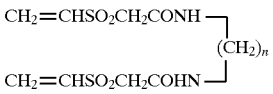

A 3:1 mixture of n=2 and n=3

Compound (31)

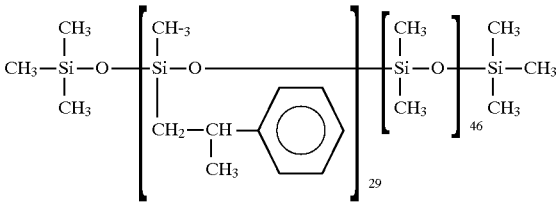

Compound (32)

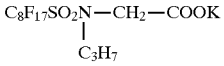

Compound (33)

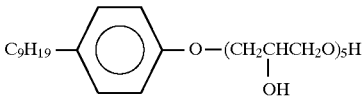

Compound (34)

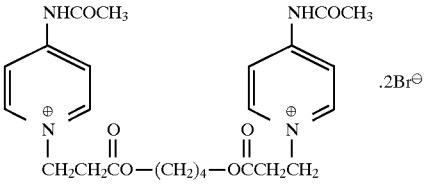

Compound (35)

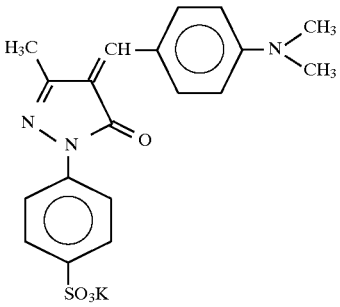

-continued

Compound (36)

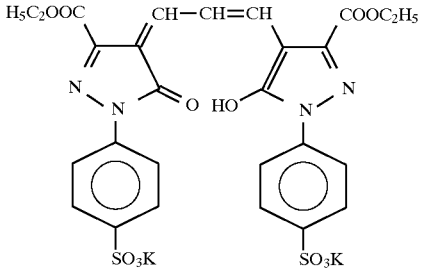

Compound (37)

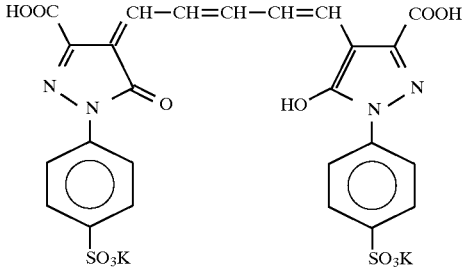

EXAMPLE 4

Photographic materials were prepared in the same manner as in Example 3, except that the following sensitizing dye (5) was used as a sensitizing dye in place of the sensitizing dye contained in the emulsion layer of Example 3, and evaluated in the same manner as in Example 1, except that the exposure was conducted with a 3200° K. tungsten light through a step wedge. Similarly to Example 1, when the photographic materials containing the hydrazine derivatives according to the present invention were combined with the developing solution according to the present invention, the photographic characteristics of being low in the pH dependency of photographic sensitivity, being high in activity, and being difficult to develop black peppers were specifically obtained.

Sensitizing Dye (5)

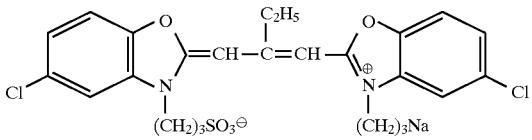

EXAMPLE 5

<Preparation of Emulsion D>

An aqueous solution of silver nitrate and an aqueous solution of sodium chloride containing $5\times10^{-5}$ mol/mol-Ag of $K_2Ru(NO)Cl_5$ were concurrently added to a 1.5% gelatin solution maintained at 38° C. and having a pH of 2.0, which gelatin solution contains sodium chloride, $3\times10^{-5}$ mol/mol-Ag of sodium benzenethiosulfonate, and $5\times10^{-3}$ mol of 4-hydroxy-6-methyl-1,3,3a,7-tetrazaindene, by the double jet process at a potential of 95 mV over a period of 3 minutes and 30 seconds so as to add half the silver amount of final grains, thereby preparing core grains having a grain size of 0.12 $\mu$m. Then, an aqueous solution of silver nitrate and an aqueous solution of sodium chloride containing $5\times10^{-5}$ mol/mol-Ag of $K_2Ru(NO)Cl_5$ were added over a period of 7 minutes in the same manner as described above to prepare cubic silver chloride grains having a mean grain size of 0.13 μm (coefficient of variation: 12%).

Thereafter, the grains were washed with water according to a common flocculation process well known in the art to remove soluble salts, followed by addition of gelatin. Then, compound (F) and phenoxyethanol were added each in an amount of 60 mg/mol-Ag as preservatives, followed by adjusting the pH to 5.5 and the pAg to 7.5. Further, $4\times10^{-5}$ mol/mol-Ag of chloroauric acid, $1\times10^{-5}$ mol of selenium compound SE and $1\times10^{-5}$ mol of sodium thiosulfate were added thereto, and heated at 60° C. for 60 minutes to conduct chemical sensitization. Thereafter, $1\times10^{-3}$ mol/mol-Ag of 4-hydroxy-6-methyl-1,3,3a,7-tetrazaindene was added as a stabilizer (silver chloride having a pH of 5.7 and a pAg of 7.5 and containing $5\times10^{-5}$ mol/mol-Ag of Ru was obtained as final grains).

(SE)

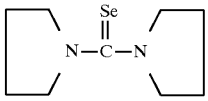

(F)

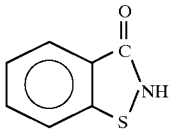

<Preparation of Coated Samples>

(Silver Halide Emulsion Layer)

The following compounds were added to emulsion D, and each of the resulting emulsions was applied onto a support having undercoat layers as described below to form a silver halide emulsion layer so as to give a gelatin coating amount of 0.9 g/m² and an Ag coating amount of 2.75 g/m².

| | |
|---|---|
| N-Oleyl-N-methyltaurine Sodium Salt | 19 mg/m² |
| Hydrazine Derivative Shown in Table 5 | 15 mg/m² |
| Nucleating Accelerator Z | 20 mg/m² |
| Sodium 3-(5-Mercaptotetrazole)benzene-sulfonate | 11 mg/m² |
| Compound A | 13 mg/m² |
| Ascorbic Acid | 1 mg/m² |
| Compound B | 15 mg/m² |
| Compound C | 70 mg/m² |
| Acetic Acid | An amount to give a film surface pH of 5.2 to 6.0 |
| Compound D | 950 mg/m² |
| Liboran-1400 (Manufactured by Lion Corp.) | 47 mg/m² |
| Compound E (Hardener) | An amount to give a water swelling rate of 80% |

Nucleating Accelerator Z

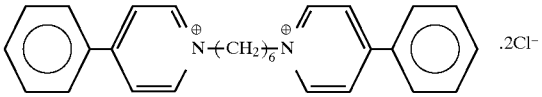

Compound A

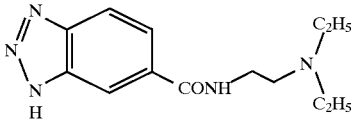

-continued

Compound B

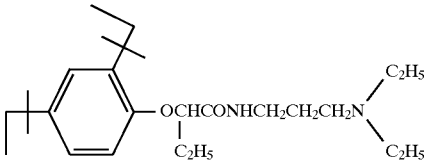

Compound C

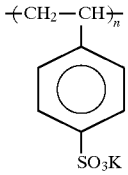

Compound D

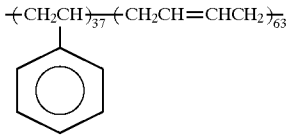

Core/shell = 50/50
<Core: St/Bu = 37/63>

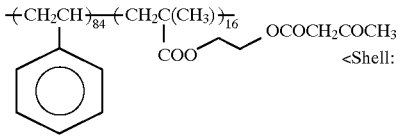

<Shell: St/AAEMA = 84/16>

Compound E

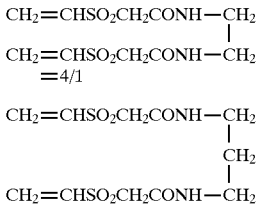

Further, the following compound was used as a hydrazine derivative for comparison.

Comparative Compound 2

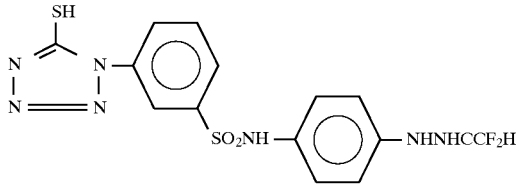

TABLE 5

| Sample No. | Hydrazine Derivative |
|---|---|
| 4-a | Comparative Compound 2 |
| 4-b | 1e |
| 4-c | 3e |
| 4-d | 4e |
| 4-e | 9e |
| 4-f | 13e |

TABLE 5-continued

| Sample No. | Hydrazine Derivative |
|---|---|
| 4-g | 22 |
| 4-h | 28c |

Lower and upper emulsion protective layers were formed on the above described emulsion layer.

(Lower Emulsion Protective Layer)

The following compounds were added to an aqueous solution of gelatin, and the resulting solution was applied so as to give a gelatin coating amount of 0.8 g/m$^2$.

| | |
|---|---|
| Gelatin ($Ca^{++}$ content: 2700 ppm) | 0.8 mg/m$^2$ |
| Compound F | 1 mg/m$^2$ |
| 1,5-Dihydroxy-2-benzaldoxime | 14 mg/m$^2$ |
| $C_2H_5SO_2SNa$ | 3 mg/m$^2$ |
| Compound C (shown above) | 3 mg/m$^2$ |
| Sodium p-Dodecylbenzenesulfonate | 7 mg/m$^2$ |

(Upper Emulsion Protective Layer)

The following compounds were added to an aqueous solution of gelatin, and the resulting solution was applied so as to give a gelatin coating amount of 0.45 g/M$^2$.

| | |
|---|---|
| Gelatin ($Ca^{++}$ content: 2700 ppm) | 0.45 mg/m$^2$ |
| Irregular Silica Matte Agent (mean grain size: 4.4 $\mu$m) | 40 mg/m$^2$ |
| Irregular Silica Matte Agent (mean grain size: 3.6 $\mu$m) | 10 mg/m$^2$ |
| Compound F | 1 mg/m$^2$ |
| Compound C (shown above) | 8 mg/m$^2$ |
| Solid Disperse Dye-$G_1$ | 68 mg/m$^2$ |
| Liquid Paraffin | 21 mg/m$^2$ |
| N-Perfluorooctanesulfonyl-N-propylglycine Potassium | 5 mg/m$^2$ |
| Sodium p-Dodecylbenzenesulfonate | 29 mg/m$^2$ |

Then, the opposite surface of the support was concurrently coated with the following coating solutions for a conductive layer and a back layer.

(Conductive Layer)

The following compounds were added to an aqueous solution of gelatin, and the resulting solution was applied so as to give a gelatin coating amount of 0.06 g/m$^2$.

| | |
|---|---|
| $SnO_2$/Sb (weight ratio: 9/1; mean grain size: 0.25 $\mu$m) | 186 mg/m$^2$ |
| Gelatin ($Ca^{++}$ content: 2700 ppm) | 0.06 g/m$^2$ |
| Sodium p-Dodecylbenzenesulfonate | 13 mg/m$^2$ |
| Sodium Dihexyl-α-sulfosuccinate | 12 mg/m$^2$ |
| Compound C | 12 mg/m$^2$ |
| Compound F | 1 mg/m$^2$ |

(Back Layer)

The following compounds were added to an aqueous solution of gelatin, and the resulting solution was applied so as to give a gelatin coating amount of 1.94 g/m$^2$.

| | |
|---|---|
| Gelatin ($Ca^{++}$ content: 30 ppm) | 1.94 mg/m$^2$ |
| Fine Polymethyl Methacrylate Grains (mean grain size: 4.7 $\mu$m) | 7 mg/m$^2$ |
| Compound H | 233 mg/m$^2$ |
| Compound I | 21 mg/m$^2$ |
| Compound G | 146 mg/m$^2$ |
| Compound F | 3 mg/m$^2$ |
| Sodium p-Dodecylbenzenesulfonate | 68 mg/m$^2$ |
| Sodium Dihexyl-α-sulfosuccinate | 21 mg/m$^2$ |
| $C_8F_{17}SO_3Li$ | 4 mg/m$^2$ |

-continued

| | |
|---|---|
| N-Perfluorooctanesulfonyl-N-propylglycine Potassium | 6 mg/m$^2$ |
| Sodium Sulfate | 177 mg/m$^2$ |
| Compound E (Hardener) (shown above) | An amount to give a water swelling rate of 80% |

(Support and Undercoat Layer)

A first undercoat layer and a second undercoat layer having the following formulations were formed on both faces of a biaxially oriented polyethylene terephthalate support having a thickness of 100 $\mu$m.

| (First Undercoat Layer) | |
|---|---|
| Core/Shell Type Vinylidene Chloride Copolymer (1) | 15 g |
| 2,4-Dichloro-6-hydroxy-s-triazine | 0.25 g |
| Fine Polystyrene Grains (mean grain size: 3 $\mu$m) | 0.05 g |
| Colloidal Silica (Snowtex ZL; grain size: 70 to 100 $\mu$m; manufactured by Nissan Chemical Industries Ltd.) | 0.12 g |
| Water to make | 100 g |

Further, 10% by weight of KOH was added thereto, and the pH was adjusted to 6. The resulting solution was applied so as to give a dry film thickness of 0.9 $\mu$m after dried at a drying temperature of 180° C. for 2 minutes.

| (Second Undercoat Layer) | |
|---|---|
| Gelatin | 1 g |
| Methyl Cellulose | 0.05 g |
| Compound J | 0.02 g |
| $C_{12}H_{25}O(CH_2CH_2O)_{10}H$ | 0.03 g |
| Compound F | $3.5 \times 10^{-3}$ g |
| Acetic Acid | 0.2 g |
| Water to make | 100 g |

This coating solution was applied so as to give a dry film thickness of 0.1 $\mu$m after dried at a drying temperature of 170° C. for 2 minutes, thereby preparing the support having the undercoat layers.

Compound F

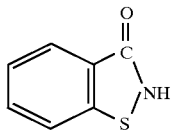

Compound G

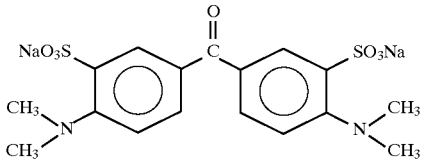

Solid Disperse Dye-$G_1$

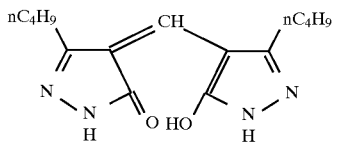

-continued

Compound H

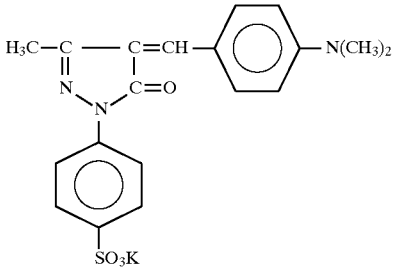

Compound I

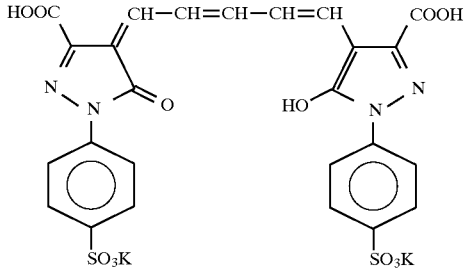

Compound J

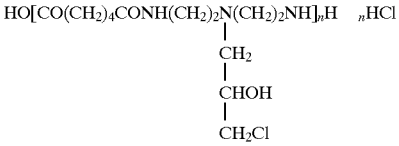

Core-shell type vinylidene chloride copolymer (1)

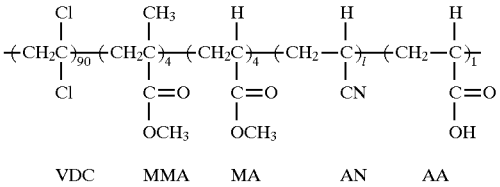

Core: VDC/MNIA/NIA (80% by weight)

Shell: VDC/AN/AA (20% by weight)

Average particle size: 70 nm,

The coating and drying were conducted as described below.

<Coating Method>

First, the support having the above described undercoat layers was subjected to a concurrent multiple coating with the emulsion layer, the lower emulsion protective layer and the upper emulsion protective layer in this order from the side close to the support while adding a hardener solution by the slide hopper system, maintaining the temperature thereof at 35° C., and passed through a cold air setting zone (5° C.). Then, on the side opposite to the emulsion surface, the support was subjected to concurrent multiple coating with the conductive layer and the back layer in this order from the side close to the support while similarly adding a hardener solution by the slide hopper system, and passed through a cold air setting zone (5° C.). At the time when passed through each setting zone, the coating solutions exhibited sufficient setting properties. Subsequently, both surfaces were concurrently dried in a drying zone by the following drying conditions. The support thus coated was transferred in no contact with any roller and the others from after coating of the back surfaces to winding. The coating speed at this time was 120 m/minute.

<Drying Conditions>

After setting, drying was carried out with drying air of 30° C. until the weight ratio of water/gelatin reached 800%, and with drying air of 35° C. and 30% from 800% to 200%. The air was directed as it is, and 30 seconds after the time when the surface temperature reached 34° C. (considered as termination of drying), drying was conducted with air of 48° C. and 2% for 1 minute. In this case, the drying time was 50 seconds from initiation of drying to a water/gelatin ratio of 800%, 35 seconds from 800% to 200%, and 5 seconds from 200% to termination of drying.

This photographic material was wound up at 23° C. at 40%, then, cut under the same circumstances, and humidified in a barrier bag humidified for 6 hours, at 40° C. at 10% for 8 hours, followed by sealing together with cardboard humidified at 23° C. at 40% for 2 hours, thereby preparing a sample. The measurement of humidity in the barrier bag indicated 40%.

<Evaluation>

The above described samples were exposed with a p-627 FM printer manufactured by Dainippon Screen Mfg. Co., Ltd. through a step wedge. The exposed samples were developed with an FG-680AG automatic processor manufactured by Fuji Photo Film Co., Ltd. at 35° C. for 20 seconds using the developing solution described in Example 1, followed by fixing (the fixing solution described in Example 2), washing and drying. The replenishing rates of the developing solution and the fixing solution are each 100 ml per $m^2$ of sample.

The gamma value, the dependency of photographic sensitivity on the pH of a developing solution, and the black peppers were evaluated in the same manner as in Example 1.

The results of the evaluation are summarized in Table 6.

TABLE 6

| Experimental No. | Sample No. | Developing Solution No. | Gamma | pH Dependency | Black Pepper | Remark |
|---|---|---|---|---|---|---|
| 2-1 | 4-a | B | 15 | 0.29 | 2 | Comparison |
| 2-2 | 4-b | B | 14 | 0.20 | 2 | Comparison |
| 2-3 | 4-c | B | 14 | 0.19 | 2 | Comparison |
| 2-4 | 4-a | C | 7 | 0.15 | 3 | Comparison |
| 2-5 | 4-b | C | 10 | 0.16 | 3 | Comparison |
| 2-6 | 4-c | C | 11 | 0.17 | 3 | Comparison |
| 2-7 | 4-a | A | 8 | 0.06 | 3 | Comparison |
| 2-8 | 4-b | A | 16 | 0.05 | 5 | Invention |
| 2-9 | 4-c | A | 17 | 0.05 | 5 | Invention |

TABLE 6-continued

| Experimental No. | Sample No. | Developing Solution No. | Gamma | pH Dependency | Black Pepper | Remark |
|---|---|---|---|---|---|---|
| 2-10 | 4-d | A | 16 | 0.06 | 5 | Invention |
| 2-11 | 4-e | A | 18 | 0.08 | 4 | Invention |
| 2-12 | 4-f | A | 18 | 0.09 | 4 | Invention |
| 2-13 | 4-g | A | 18 | 0.08 | 4 | Invention |
| 2-14 | 4-h | A | 17 | 0.07 | 5 | Invention |

<Results>

When the photographic materials containing the hydrazine derivatives according to the present invention were combined with the developing solutions according to the present invention, the photographic characteristics of being low in the pH dependency of photographic sensitivity, being high in activity, and being difficult to develop black peppers were specifically obtained.

EXAMPLE 6

Developing solution D having the following formulation (the same formulation as that of developing solution A) and fixing solution B having the following formulation, each of which is stored in the solid state, were prepared. In order to examine the pH dependency of photographic sensitivity, sodium hydroxide was added to developing solution D to increase the pH by 0.3, thereby preparing developing solution D+, and acetic acid was added to lower the pH by 0.3, thereby preparing developing solution D−.

<Developing Solution D>

Water was added to the following developing agent stored in the solid state to make 1 liter, thereby preparing a working solution having a pH of 9.7.

The formulation of the solid developing agent is shown below:

| | |
|---|---|
| Sodium Sulfite (raw powder) | 2 g |
| Potassium Carbonate (raw powder) | 33 g |
| Sodium Carbonate (raw powder) | 28 g |
| Sodium Hydrogencarbonate (raw powder) | 25 g |
| (The following components were briquetted in admixture) | |
| Diethylenetriaminepentaacetic Acid | 2 g |
| Sodium Erythorbate | 45 g |
| N-Methyl-p-aminophenol | 7.5 g |
| KBr | 2 g |
| 5-Methylbenzotriazole | 0.004 g |
| 1-Phenyl-5-mercaptotetrazole | 0.02 g |

As the raw powders, ordinary industrial products were used as they were. For the briquettes, the components were compressed by application of pressure with a briquetting machine to form irregular rugby ball-shaped briquettes having a length of about 4 mm to about 6 mm, and then pulverized. The components contained in small amounts were briquetted after blending of the respective components.

<Fixing Solution B>

The formulation of the solid fixing agent is shown below.

| Agent A (Solid) | |
|---|---|
| Ammonium Thiosulfate (compact) | 125.0 g |
| Sodium Thiosulfate Anhydride (raw powder) | 19.0 g |
| Sodium Metabisulfite (raw powder) | 18.0 g |
| Sodium Acetate Anhydride (raw powder) | 42.0 g |

-continued

| Agent B (Liquid) | |
|---|---|
| Disodium Ethylenediaminetetraacetate Dihydrate | 0.03 g |
| Citric Anhydride | 3.7 g |
| Sodium Gluconate | 1.7 g |
| Aluminum Sulfate | 8.4 g |
| Sulfuric Acid | 2.1 g |
| Water to make | 50 ml |

Agents A and B were dissolved in water to make 1 liter (pH: 4.8).

Ammonium thiosulfate (compact), which was obtained by compressing flakes prepared by the spray dry process by application of pressure with a roller compactor followed by pulverizing them to irregular chips having a size of about 4 mm to about 6 mm, was used, and blended with sodium thiosulfate anhydride. As the other raw powders, ordinary industrial products were used as they were.

Each 10 liter portions of agent A and agent B were charged into foldable high density polyethylene containers, respectively. A takeout port of the container for agent A was sealed with aluminum, and a port of the container for agent B was sealed with a screw cap. For dissolution and replenishment, a dissolving and replenishing apparatus equipped with an automatic opening mechanism.

Even when developing solution D and fixing solution B were used in Examples 1 to 6 in place of developing solution A and fixing solution A, respectively, similar results were obtained.

While the invention has been described in detail and with reference to specific examples thereof, it will be apparent to one skilled in the art that various changes and modifications can be made therein without departing from the spirit and scope thereof.

What is claimed is:

1. An image forming method comprising developing a silver halide photographic light-sensitive material which comprises a support having thereon at least one light-sensitive silver halide emulsion layer which has been subjected to image-wise exposure, wherein the silver halide photographic light-sensitive material contains at least one kind of hydrazine derivative represented by general formula (NB) in at least one layer of the silver halide emulsion layer(s) and other hydrophilic colloid layers:

$$A—(B)_m \quad \text{(NB)}$$

wherein A represents a connecting group, B represents a group represented by the following general formula (B-1), and m represents an integer of 2 to 6:

$$—(L_2—Ar_2)_n—L_1—Ar_1—NHNH—G_1—R_1 \quad \text{(B-1)}$$

wherein $Ar_1$ and $Ar_2$ each represents an aromatic group or an aromatic heterocyclic group; $L_1$ and $L_2$ each represents a connecting group; n represents 0 or 1; $R_1$ represents a hydrogen atom, an alkyl group, an aryl group, a heterocyclic group, an alkoxyl group, an aryloxy group, an amino group or a hydrazino group; $G_1$ represents —CO—, —$SO_2$—, —SO—, —P(=O) ($R_2$)—, —CO—CO—, a thiocarbonyl group or an iminomethylene group; $R_2$ is selected from those defined from $R_1$ and may be different from $R_1$, and wherein the development is conducted by using a developing solution having a pH of from not less than 8.5 to less than 11.0, which developing solution is free from a dihydroxybenzene developing agent, but contains a developing agent represented by general formula (1):

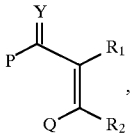

(1)

wherein $R_1$ and $R_2$ each represents a hydroxyl group, an amino group, an acylamino group, an alkylsulfonylamino group, an arylsulfonylamino group, an alkoxycarbonylamino group, a mercapto group or an alkylthio group; P and Q each represents a hydroxyl group, a hydroxyalkyl group, a carboxyl group, a carboxyalkyl group, a sulfo group, a sulfoalkyl group, an amino group, an aminoalkyl group, an alkyl group, an alkoxyl group, a mercapto group, or P and Q each represents atomic groups necessary for bonding each other to form a 5-, 6- or 7- membered ring together with the two vinyl carbon atoms at which $R_1$ and $R_2$ are substituted and with the carbon atom at which Y is substituted; =Y represents =O or =N—$R_3$; and $R_3$ represents a hydrogen atom, a hydroxyl group, an alkyl group, an acyl group, a hydroxyalkyl group, a sulfoalkyl group or a carboxyalkyl group;

wherein the silver halide photographic light-sensitive material further contains a nucleating accelerator in at least one layer of the silver halide emulsion layer(s) and the other hydrophilic colloidal layers.

2. The image forming method of claim 1, wherein the nucleating accelerator comprises at least one kind of nucleating accelerator represented by general formula (A-1), (A-2), (A-3) or (A-4):

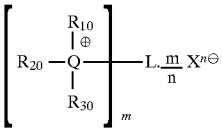

(A-1)

wherein $R_{10}$, $R_{20}$ and $R_{30}$ each represents an alkyl group, a cycloalkyl group, an aralkyl group, an aryl group, an alkenyl group, a cycloalkenyl group, an alkynyl group or a heterocyclic group; Q represents a nitrogen atom or a phosphorus atom; L represents an m-valent organic group bonded to $Q^+$ with its carbon atom, wherein m represents an integer of from 1 to 4; and $X^{n-}$ represents an n-valent counter anion, wherein n represents an integer of from 1 to 3, providing that when $R_{10}$, $R_{20}$, $R_{30}$ or L has an anion group in its substituent group to form an internal salt with $Q^+$, $X^{n-}$ is not needed;

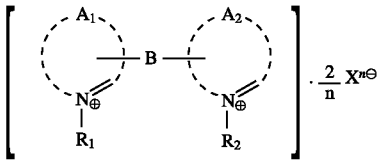

(A-2)

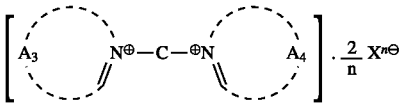

(A-3)

wherein $A_1$, $A_2$, $A_3$ and $A_4$ each represents an organic residue which contains a quaternized nitrogen atom and is for completing a substituted or unsubstituted unsaturated heterocyclic ring; B and C each represents a divalent connecting group comprising alkylene, arylene, alkenylene, alkynylene, —$SO_2$—, —SO—, —O—, —S—, —N($R_N$)—, —C=O— or —P=O—, alone or in combination of two or more thereof, wherein $R_N$ represents a hydrogen atom, an alkyl group, an aryl group or an aralkyl group; $R_1$ and $R_2$ each represents an alkyl group or an aralkyl group; and $X^{n-}$ represents an n-valent counter anion, wherein n represents an integer of from 1 to 3, providing that when an internal salt can be formed, $X^{n-}$ is not needed; and

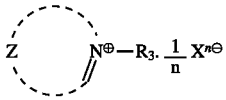

(A-4)

wherein Z represents an organic residue which contains a quaternized nitrogen atom and is for completing a substituted or unsubstituted unsaturated heterocyclic ring; $R_3$ represents an alkyl group or an aralkyl group; and $X^{n-}$ represents an n-valent counter anion, wherein n represents an integer of from 1 to 3, providing that when an internal salt can be formed, $X^{n-}$ is not needed.

3. The image forming method of claim 1, wherein the silver halide emulsion is chemically sensitized.

4. The image forming method of claim 3, wherein the chemical sensitization is a selenium sensitization or a tellurium sensitization.

5. The image forming method of claim 1, wherein the silver halide emulsion has a silver halide composition having a silver chloride content of not less than 50 mol %.

6. The image forming method of claim 1, further comprising imagewise exposing the silver halide photographic light-sensitive material, wherein the development is conducted after the imagewise exposure, while replenishing a developing solution.

* * * * *